US007856848B2

(12) United States Patent
Lu

(10) Patent No.: US 7,856,848 B2
(45) Date of Patent: Dec. 28, 2010

(54) FLEXIBLE HYDROCARBON GAS SEPARATION PROCESS AND APPARATUS

(76) Inventor: Yingzhong Lu, 104 Harrland Ct., Oak Ridge, TN (US) 37830

( * ) Notice: Subject to any disclaimer, the term of this patent is extended or adjusted under 35 U.S.C. 154(b) by 967 days.

(21) Appl. No.: 11/713,757

(22) Filed: Mar. 5, 2007

(65) Prior Publication Data

US 2008/0016909 A1 Jan. 24, 2008

(30) Foreign Application Priority Data

Jul. 19, 2006 (CN) ..... 2006 1 0099387

(51) Int. Cl.
*F25J 3/00* (2006.01)

(52) U.S. Cl. ..... 62/623; 62/630; 62/631

(58) Field of Classification Search ..... 62/623, 62/618, 620, 630, 912; 95/149, 156, 172
See application file for complete search history.

(56) References Cited

U.S. PATENT DOCUMENTS 2,868,326 A * 1/1959 Gilmore ..... 95/156
4,435,198 A * 3/1984 Gray ..... 62/622
5,664,426 A * 9/1997 Lu ..... 62/93
6,553,784 B2 * 4/2003 Lu ..... 62/632
2003/0014995 A1 * 1/2003 Bowen et al. ..... 62/623
2003/0033827 A1 * 2/2003 Lu ..... 62/317

* cited by examiner

*Primary Examiner*—Cheryl J Tyler
*Assistant Examiner*—Lukas Baldridge

(57) ABSTRACT

The present invention related to a flexible hydrocarbon gas separation process that could dehydrate the water-saturated hydrocarbon gas mixture and recover thereof the required higher hydrocarbons (NGL) therein with a controllable ethane recovery rate (ranging from >95% to <2%) while keeping high recovery rate of all other heavier components. The flexible process comprises the following steps: deep-cooling and dehydrating the raw gas and get the NGL condensate; flowing the deep-dehydrated gas into the flexible absorber to get the rich oil with desirable ethane content; completely demethanizing and partially deethanizing as desired the rich oil and the NGL condensate to get purified rich oil and purified NGL condensate, respectively; separating the NGL vapor from the purified rich oil; cooling and compressing the NGL vapor; mixing the NGL vapor with the purified NGL condensate; and liquefying the mixture to get the final NGL product. The present invention also provides a flexible apparatus with highly efficient components for the flexible process.

13 Claims, 8 Drawing Sheets

FLEXIBLE HYDROCARBON GAS SEPARATION PROCESS AND APPARATUS

BACKGROUND OF THE INVENTION

The rapid globalization of world economy, expansion of world population and rise of living standards lead to tremendous energy demand. Since the present oil and gas supply could hardly always match the rapidly rising market demand, their prices are escalating and unpredictable. In particular, due to the difficulties of storage and overseas transportation, the natural gas price is more volatile.

The separation of selected hydrocarbon components from a water-saturated hydrocarbon gas mixture (abbreviated as "raw gas" hereafter), in particular, the separation of the natural gas liquid (abbreviated as "NGL" hereafter) from natural gas, would consume a significant portion of the raw gas. The gas is consumed not only as the raw material, but also as the fuel to generate heat and power required for the energy-intensive separation process. The production cost of NGL, therefore, escalates with the gas price. However, the NGL is not the end-use product itself. As a liquid mixture, the NGL product must be further fractionated into its components and sold to different end users on the market. The market price of each NGL component would fluctuate according to their respective market demands. As a consequence, their respective net profit would be quite different. For instance, the market price of ethane rose much slower recently than other components when gas price went up. The net profit of ethane production may even become negative at peak gas price. On the contrary, the net profits of certain other NGL component, such as propane, would become more attractive due to the increasing LPG demand.

In such a volatile NGL components market, the prevailing Cryogenic Process for NGL separation is facing a serious challenge. The energy-intensive Cryogenic process has been greatly favored in the past because of its high ethane recovery level (~90%). Facing the shrinking profit of ethane production, however, the overall net profits of existing Cryogenic separation plants have been declining. Many Cryogenic separation plants had to operate on so-called "ethane-rejection" cycle. In the ethane-rejection operations, the liquid ethane, separated after gas expansion, had to be re-evaporated from the NGL mixture and re-compressed to the original gas pressure, mixed with the residue gas, and sold at the same price of the raw gas. The energy consumed in the whole ethane-separation and ethane-rejection processes was completely wasted. The overall profit of the Cryogenic plants, therefore, would be decreasing faster due to its higher ethane recovery rate as compared with other separation processes. As a result, the future of the Cryogenic process becomes uncertain.

Numerous improvements have been proposed for lowering ethane-rejection costs. Among so-called "Next Generation" Cryogenic processes, a number of US patents have been granted, such as the U.S. Pat. Nos. 4,854,955; 4,889,545; 5,568,737; 5,711,712; 5,799,507 and 5,881,569. Since all these patents are still based on cryogenic expansion cycle wherein the bulk raw gas must be expanded to sufficiently low pressure to create the required low cryogenic temperature, the residue gas has to be recompressed to pipeline pressure before sent out. The recompression power, therefore, could not be significantly reduced. On the other hand, the recovered NGL decreases substantially due to the rejection of ethane. As a result, the average energy cost per unit of the NGL products would rapidly increase, and the overall plant net profit drops accordingly. All these improved "Next Generation" cryogenic processes, therefore, could hardly make Cryogenic process more competitive in future NGL market.

A different approach based on the Absorption process has also been proposed to solve the problem. The traditional refrigerated oil absorption process (abbreviated as "ROA process" hereafter) failed to compete with Cryogenic process due to its lower ethane recovery rate and higher refrigeration energy consumption. Presently, the first weakness is no longer a drawback. To eliminate the second weakness, i.e., higher refrigeration energy consumption, a lot of efforts have been made to find alternative absorbents that could selectively absorb heavier hydrocarbons at ambient temperature. For example, Dr. Mehra has identified a number of such novel absorbents and received a series of U.S. Pat. Nos. 4,421,535; 4,511,381; 4,526,594; 4,578,094; 4,698,688; 5,561,988; and 5,687,584, etc. He has also made notable progresses in commercializing his process during past two decades. However, due to the higher costs and the lack of industrial operational experience of those novel absorbents, the market share of the so-called "Mehra process" is still limited, and does not have significant impact on gas industry. It is, therefore, not expected to become a widely accepted alternative to the declining Cryogenic process in foreseeable future.

Another approach based on radically improvements on traditional ROA process has been proposed more recently by the present inventor to substantially reduce the refrigeration energy consumption while still using similar heavy oil absorbents under refrigeration temperature. The basic idea is to integrate the technology of refrigeration dehydration of natural gas with the improved heat-recuperated rich oil processing process. In April 2003, the U.S. Pat. No. 6,553,784 "Comprehensive Natural Gas Processor" based on an innovative "Improved Refrigeration Oil Absorption Process" (abbreviated as "IROA process" hereafter) was granted. The IROA process could substantially reduce the required refrigeration power and heat energy and effectively meet the challenge of the volatile NGL market, while still inheriting the matured experience of traditional ROA process. According to a preliminary computer simulation of the IROA process, as reported on AIChE 2005 Spring Meeting, April 11-14 2005, Atlanta, the IROA process could compete favorably with Cryogenic process over a wide range of ethane recovery rates, notably from ~70% down to ~2%, for a wide variety of raw gas. The widely accepted expertise of the traditional ROA process currently in operation would give excellent market penetration prospect of the IROA process under development.

However, being emphasized on the improvements on the head and bottom ends of the ROA process, said patent has not fully explored the potential of the flexibility and energy-savings of the IROA process over the entire ethane recovery range between >95% down to <2%, particularly at the highest and the lowest ends of the ethane recovery range, in comparison with the Mehra process.

Accordingly, it is an objective of the present invention to provide a fully flexible improved refrigerated absorption process (abbreviated as "FIRA process" hereafter) that could control the desirable ethane recovery rate from >95% down to <2% during operations to best meet the challenge of the volatile NGL market.

Another objective of the present invention is to provide a fully energy-integrated FIRA apparatus that could substantially reduce the unit product energy consumption and maximize the profits of the FIRA gas separation plant during operations over the full range of ethane recovery rate from >95% down to <2%.

A further objective is to provide high-performance components for the FIRA process and reduce the capital costs of the FIRA gas separation plant.

BRIEF SUMMARY OF INVENTION

With regard to the above and other objectives, the present invention provides a fully flexible improved refrigerated absorption (FIRA) process that could recover NGL from the raw gas and control the ethane recovery rate from >95% to <2% while maintaining high recovery rates (>90%) of other heavier components. Besides the flexibility of the ethane recovery rates, the flexibility of the process also reflects in the following features: (1) flexibility of handling the raw gas with a wide range of water contents and gas composition; (2) flexibility of handling the raw gas under a wide range of pressure, e.g., from the deep-well gas (>1000 psia) to the refinery off-gas (<200 psia); (3) flexibility of using various types of high gas solubility, highly selective, and low volatile absorbents (abbreviated as "lean oil" hereafter), including the heavy oils and other organic absorbents; and (4) flexibility of selecting and reorganizing various steps of the typical FIRA process to construct alternative processes to meet different production objectives and/or to retrofit exiting gas processing plants.

A typical FIRA process includes the following major steps: (1) pre-cooling and pre-dehydrating the raw gas with directly contact a counter-flowing liquid coolant comprising of an aqueous solution of a gas hydrate inhibitor to get the pre-cooled pre-dehydrated gas and the partial NGL condensate; (2) deep-cooling and deep-dehydrating the pre-cooled pre-dehydrated gas with the refrigerant from an external refrigerator to get the deep-cooled deep-dehydrated gas and the deep-cooled NGL condensate; (3) flowing the NGL condensate into a condensate pre-demethanizer and a flexible condensate deethanizer in tandem to remove all the methane content therein and simultaneously reduce the ethane contend therein to any desirable level to get the deep-cooled purified NGL condensate; (4) flowing the deep-cooled deep-dehydrated gas into a flexible absorber wherein contacting the gas with a counter-flowing liquid lean oil to get the cold residue gas and the cold rich absorbent (abbreviated as "rich oil" hereafter) with desirable level of ethane content; (5) flowing the cold rich oil into a rich oil pre-demethanizer and a flexible rich oil deethanizer in tandem to remove all the methane content therein and simultaneous reduce the ethane content therein to any desirable level to get the purified rich oil; (6) depressurizing the purified rich oil and distilling the purified rich oil in a rich oil fractionator to get the NGL vapor and the regenerated lean oil; (7) cooling the NGL vapor with a heat transport medium to transport the heat energy from the NGL vapor to the deep-cooled rich oil in the flexible rich oil deethanizer; (8) compressing the NGL vapor and mixing the compressed NGL vapor with the deep-cooled purified NGL condensate to get the low-temperature NGL vapor-liquid mixture; and (9) liquefying the low-temperature NGL vapor-liquid mixture to get final NGL product.

The present invention also provides a fully energy-integrated gas separation process that could substantially reduce the energy consumption over the entire range of ethane recovery rate from >95% to <2% and guarantee maximum profit of the separation plant in the volatile NGL market. The fully energy-integration process include the following features: (1) utilizing the cold residue gas and cold rich oil as coolants to directly or indirectly pre-cool the inlet raw gas and the pre-dehydrated gas in the pre-dehydrator; (2) utilizing the hot regenerated lean oil as heating medium to pre-heat the purified rich oil in the rich oil fractionator; (3) utilizing the hot regenerated lean oil as heating medium to heat the cold rich oil in the rich oil deethanizer; (4) utilizing the hot regenerated lean oil as heating medium to heat the deep-cooled NGL condensate in the condensate deethanizer; (4) utilizing the hot NGL vapor as heating medium to pre-heat the cold rich oil in the rich oil deethanizer; and (5) mixing the deep-cooled purified NGL condensate with the compressed NGL vapor to reduce the liquefaction power for NGL product.

The present invention also provides a fully energy-integrated FIRA apparatus with highly efficient components that could substantially reduce the energy consumption and maximize the profits of the FIRA gas separation plant. The high-performance components include, but not limited to, the cascade flexible deethanizers, and the dual-function exchanger-reactors.

BRIEF DESCRIPTION OF SEVERAL VIEWS OF THE DRAWING

The above and other features and advantages of the present invention will now be further described in the following detailed description section in conjunction with the attached drawings in which.

DETAILED DESCRIPTION

Figure 1:
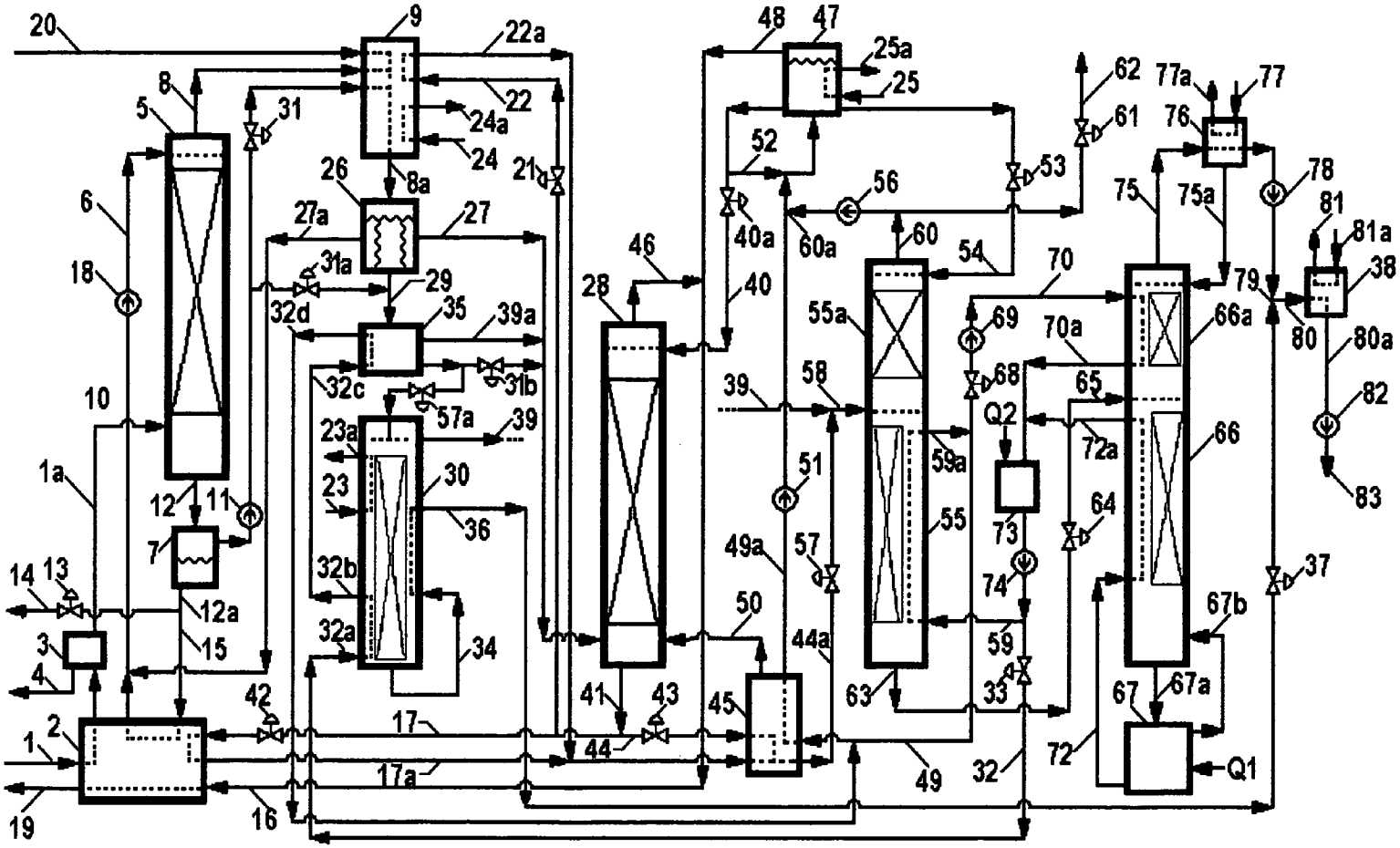
FIG. 1 illustrates the basic flow diagram of the typical flexible hydrocarbon gas separation process wherein an external refrigerator is used to provide the refrigerant for deep-cooling the raw gas and lean oil.

FIG. 1 illustrates the basic flow diagram of the typical flexible hydrocarbon gas separation process wherein an external refrigerator is used to provide the refrigerant for deep-cooling the raw gas and lean oil.

In FIG. 1, the raw hydrocarbon gas saturated with water vapor enters the primary heat exchanger 2 via gas inlet pipe 1. There are two coolant streams in the prime heat exchanger, i.e., (1) the deep-cooled residue gas stream, entering via the master residue gas pipe 16 and leaving via the residue gas discharge pipeline 19 to the external gas transport pipeline (not shown), and (2) the deep-cooled rich oil stream regulated with rich oil regulation valve 42, coming via rich oil pipe 17, and leaving via rich oil pipe 17*a*. The raw gas is cooled to a temperature above the hydrate formation threshold, and then the cooled gas enters the moisture separator 3 wherein the entrained condensed water droplets are separated and discharged via the water drainage pipe 4. The pre-treated gas then enters the pre-cooler/dehydrator 5 (abbreviated as "pre-dehydrator" hereafter) via the pre-treated gas inlet pipe 1*a*, flows upward, and is cooled by directly contacting a down-flowing liquid coolant. The liquid coolant is an aqueous solution of a gas hydrate inhibitor (e.g. ethylene glycol, calcium chloride, etc.), entering the pre-dehydrator at the top via coolant inlet pipe 6 and a booster pump 18. When the pre-treated gas is further cooled in the pre-dehydrator, the major portion of water vapor is condensed and dissolved into the coolant solution. A certain fraction of the heavier hydrocarbon vapor of the raw gas may also condense, according to the richness of the higher hydrocarbons in the raw gas. This portion of higher hydrocarbons condensate (abbreviated as "partial NGL condensate" hereafter), immiscible to the coolant, flows downward together with the coolant. The mixed flow is discharged via the liquid discharge pipe 12 into the two-phase separator 7. The pre-dehydrated gas, flowing upward, leaves the pre-dehydrator via pre-dehydrator outlet pipe 8. Since the moisture content therein is still exceeds the allowable level required by the subsequent refrigeration absorber, the pre-dehydrated gas is sent into the deep-cooler/dehydrator 9 (abbreviated as "deep-dehydrator" hereafter).

In the two-phase separator 7, the partial NGL condensate, if any, is separated from the liquid mixture. The separated partial NGL condensate is sent via condensate outlet pipe 10, though the condensate booster pump 11 and the shift valve 31 (normally open), into the deep-dehydrator. The boosted partial NGL condensate is mixed therein with the pre-dehydrated gas stream to increase the ethane content of the NGL condensate. In case the system needs to operate under ethane-rejection mode, the partial NGL condensate should directly flow into the condensate pre-demethanizer 35 by closing shift valve 31 (normally open) and opening the other shift valve 31*a* (normally close).

The aqueous coolant, separated in the two-phase separator 7, is discharged via the coolant outlet pipe 12*a* and split into two streams. The bulk coolant stream, sent via coolant transfer pipe 15 into the primary heat exchanger 2, is deeply cooled therein with the deep-cooled residue gas coming from the residue gas master pipe 16 and the deep-cooled rich oil coming from rich oil inlet pipe 17. The deep-cooled bulk coolant stream is then boosted with coolant booster pump 18 and re-enters the pre-dehydrator 5 via coolant inlet pipe 6.

The minor portion of the separated aqueous coolant, regulated with the regulating valve 13, is sent via the regeneration coolant pipe 14 to the external glycol regenerator not shown in FIG. 1.

The make-up inhibitor solution is sent via inhibitor make-up pipe 20 to mix with the pre-dehydrated gas and the NGL condensate stream in the deep-dehydrator, 9. The gas-liquid mixture is deeply cooled therein to the low temperature required by the subsequent flexible absorber 28. A considerable portion of the higher hydrocarbon gas is condensed therein as the NGL condensate, according to the richness of the higher hydrocarbon content of the raw gas.

There are two streams of coolants flow in the deep-dehydrator 9: (1) the refrigerant, coming from an external refrigerator (not shown) via the refrigerant inlet pipe 24 and leaving via the refrigerant outlet pipe 24*a*, and (2) the deep-cooled rich oil regulated with rich oil regulation valve 21, coming via the rich oil inlet pipe 22 and leaving via the rich oil outlet pipe 22*a*. The mixed flow of the deep-cooled gas, inhibitor solution and NGL condensate, is discharged at the bottom, via the mixture discharge pipe 8*a*, into the three-phase separator 26, wherein the three phases are separated. The separated deep-dehydrated gas (abbreviated as "cold dry gas" hereafter) is sent via cold dry gas outlet pipe 27 into the flexible absorber 28. The separated inhibitor solution is sent via the inhibitor solution outlet pipe 27*a* into the coolant inlet pipe 6. The separated NGL condensate is sent via the NGL condensate outlet pipe 29 into the NGL condensate pre-demethanizer 35.

The condensate pre-demethanizer 35 is heated with a stream of the hot regenerated lean oil regulated with the recycling lean oil regulating valve 33, coming via the lean oil inlet pipe 32*c* and leaving via the lean oil outlet pipe 32*d*. A significant portion of the methane, together with a small amount of ethane and trace of higher hydrocarbons, is evaporated as the residue gas from the condensate. The residue gas is then sent via residue gas outlet pipe 39*a* to merge with the cold dry gas flowing in the cold dry gas pipe 27. The gas mixture is then sent into the flexible absorber 28 for further processing. The pre-demethanized NGL condensate is sent via the condensate de-pressurization valve 57*a* into the flexible condensate deethanizer 30 for complete demethanization and appropriate deethanization as required.

The flexible condensate deethanizer 30 is made of an exchanger-reactor wherein the pre-demethanized NGL condensate flows down from the top as a liquid film covering the wall of the first group of narrow flow channels (shown as a thin-lined slender rectangular block). The liquid film is first cooled with a refrigerant flowing in the second group of channels, shown as a bold dotted line, coming via the refrigerant inlet pipe 23 and leaving via refrigerant outlet pipe 23*a*. The liquid film is then pre-heated with the recycling purified NGL condensate, flowing inside the third group of channels, shown as a bold dotted line, coming via recycling purified condensate pipe 34 and leaving via deep-cooled NGL condensate pipe 36. The liquid film is eventually heated in the lower section of the flexible condensate deethanizer with the hot lean oil, flowing inside the fourth group of channels, shown as a bold dotted line, coming via lean oil inlet pipe 32*a* and exits via lean oil outlet pipe 32*b*. All the methane and a desirable fraction of ethane in the NGL condensate liquid film are evaporated as the residue gas, together with trace of heavier hydrocarbon, when the liquid film arrives at the bottom of the flexible condensate deethanizer. The residue gas flows upward and directly contacts the down-flowing liquid film. The heaviest hydrocarbon components in the residue gas are essentially stripped back into the liquid film. By adjusting the working pressure and the bottom temperature of the flexible condensate deethanizer, the ethane content in the final purified condensate could be easily controlled. The residue gas, eventually leaving via residue gas outlet pipe 39, is sent to the flexible rich oil deethanizer 55 for further processing.

In the flexible absorber 28, the deep-cooled, deep-dehydrated gas mixture enters from the bottom, flows upward, and directly contacts the down-flowing lean oil coming from the top via lean oil inlet pipe 40. Although a variety of absorbents, either traditional or novel, could be used in this invention, the low-volatility heavy oil (e.g., average molecular weights higher than ~140) with high NGL solubility (e.g., >20 scf/gal) is generally preferred in view of their extensive operational practice in gas industry. By varying the molar flow ratio of the lean oil vs. gas, the ethane recovery rate may easily be controlled while keeping very high recovery rates of all other heavier (C3+) components. However, since it is generally desirable to keep the C3 recovery higher than 95%, the decrease of the molar flow ratio of the lean oil vs. gas would have a lower boundary. Subject to this constraint, the reasonable minimum value of C2 recovery rate with lean oil would be around 30%. To further reduce the C2 recovery rate below ~30%, additional ethane-rejection in the subsequent flexible rich oil deethanizer is needed. The extra energy consumption of the ethane-rejection operations in present invention, however, is much less than that in current Cryogenic process. It is because in present invention: (1) the maximum ethane content needs to be re-evaporated at the minimum C2 recovery level (2%) is much less than current Cryogenic process, and (2) the pressure of the residue gas from ethane-rejection operations to be recompressed is significantly higher than current Cryogenic process. As a result, the extra energy consumption resulted from ethane-rejection operations in present invention would be much less than current Cryogenic process.

The deep-cooled residue gas is discharged from the top of the flexible absorber, via absorber residue gas discharge pipe 46, and mixed with the other stream of deep-cooled residue gas stream flowing in the deethanizer residue gas discharge pipe 48. As described above, the mixed deep-cooled residue gas flows via residue gas master pipe 16 into the primary heat exchanger 2 to pre-cool the inlet raw gas. This is one important energy-integration measure of present invention.

The deep-cooled rich oil is discharged via rich oil discharge pipe 41 from the bottom of the flexible absorber. As another important energy-integration measure of present invention, the deep-cooled rich oil is used as a cooling medium in several heat-exchanging components, including (1) the primary heat exchanger 2 (regulated with the regulation valve 42); (2) the deep-dehydrator 9 (regulated with the regulation valve 21); and (3) the rich oil pre-demethanizer 45 (regulated with the regulation valve 43).

In the pre-demethanizer, the deep-cooled rich oil is preheated with the recycling lean oil, coming via cold recycling lean oil pipe 49 and leaving via deep-cooled recycling lean oil pipe 49*a*. A significant portion of the dissolved methane and a small portion of ethane are evaporated as the residue gas and return to the flexible absorber via residue gas transfer pipe 50. The pre-demethanized rich oil is then flashed via the rich oil de-pressurization valve 57 into a lower pressure vapor-liquid mixture. The vapor-liquid mixture enters the flexible rich oil deethanizer via rich oil mixture inlet pipe 58, at the junction between the upper and lower sections, 55 and 55*a*, wherein the liquid and the vapor are separated. The liquid rich oil flows downward as a liquid film covering the wall of the first group of narrow flow channels (shown as a thin-line slender rectangular block) of the lower section 55, while the residue gas flows upward along the other group of narrow flow channels (also shown as a thin-line slender rectangular block) of the upper deethanizer section 55*a*. In the lower deethanizer section, there is a second group of flow channels for the up-flowing hot lean oil, shown as bold dotted line, coming via recycling lean oil inlet pipe 59 and leaving via recycling lean oil outlet pipe 59*a*. The down-flowing rich oil is heated with the up-flowing hot lean oil. At the bottom of the lower deethanizer section, the dissolved methane in the rich oil is completely evaporated, together with a desired portion of the dissolved ethane, controlled with the bottom temperature of the liquid film. The evaporated residue gas, flowing upward, is stripped with the colder rich oil film. At the bottom of the lower deethanizer section, the purified rich oil, already completely demethanized and partially deethanized to desired level, is discharged via purified rich oil outlet pipe 63.

Inside the upper section of the flexible rich oil deethanizer, there is only one group of narrow flow channels (shown as a thin-line slender rectangular block). A stream of deep-cooled stripping lean oil, regulated with the stripping lean oil regulation valve 53, enters via the stripping lean oil inlet pipe 54. The trace hydrocarbons heavier than ethane is essentially stripped from the residue gas with the stripping lean oil. The portion of ethane stripped therein is controlled with changing the molar flow ratio of the stripping lean oil vs. the residue gas. The stripping lean oil eventually reaches the bottom of the upper deethanizer section, and merges with the rich oil liquid entering the lower deethanizer section.

The residue gas leaves the upper deethanizer section via residue gas outlet pipe 60. The residue gas is then split into two streams. The minor stream of the residue gas, regulated with the fuel gas de-pressurization valve 61, is delivered as fuel gas, via fuel gas pipe 62. The bulk stream of the residue gas is re-compressed with the residue gas compressor 56 to a pressure slightly higher than the raw gas. The high-pressure residue gas is then sent into the T-joint 60*a* to mix with the reflux pre-saturated lean oil, coming from reflux lean oil pipe 52, and the recycling lean oil, coming from deep-cooled recycling lean oil pipe 49*a* and pressurized with the lean oil booster pump 51. The gas-liquid mixture then enters the lean oil pre-saturator 47 under high turbulence, wherein the recycling lean oil is saturated with the methane of the residue gas, and deep-cooled in the lean oil pre-saturator with a refrigerant, entering via the refrigerant inlet pipe 25 and leaving via the refrigerant outlet pipe 25*a*. The deep-cooled residue gas and saturated lean oil are then separated in the pre-saturator. The separated residue gas is discharged via deethanizer residue discharge pipe 48 to merge with the other stream of residue gas, coming from the flexible absorber 28 via residue gas discharge pipe 46. The separated pre-saturated lean oil is divided into two streams. One stream, regulated by the first regulation valve 40*a*, is sent via the saturated lean oil pipe 40 into the flexible absorber 28 as the absorbent. The other stream is recycled via recycling lean oil pipe 52 into the pre-saturator to enhance the mixing process.

The next step is the separation of the desired NGL product from the purified rich oil. For this purpose, the purified rich oil is first flashed via the rich oil de-pressurization valve 64 into a vapor-liquid mixture. The vapor-liquid mixture enters the rich oil fractionator via the flashed purified rich oil inlet pipe 65 at the junction between the lower and upper section, 66 and 66*a*, therein the liquid and the vapor are separated. The separated liquid purified rich oil flows downward as liquid film covering the wall of the lower first group of channels (shown as a thin-line slender rectangular block) of the lower fractionator section 66, while the separated NGL vapor flows upward along the upper first group of channels (shown as a thin-line slender rectangular block) of the upper fractionator section 66*a*.

In the lower fractionator section 66, the down-flowing purified rich oil liquid film is heated by the up-flowing recycling hot lean oil up-flowing inside the lower second group of channels, shown as bold dotted line, coming via the recycling hot lean oil discharge pipe 72 and leaving via the recycling lean oil outlet pipe 72*a*. The bottom temperature of the lower fractionator section is so controlled that the dissolved NGL components are essentially evaporated. The liquid is then purified as the regenerated lean oil. To further purify the regenerated lean oil to meet the reusable absorbent spec, the bottom liquid is discharged via lean oil discharge pipe 67*a* into the re-boiler 67. The regenerated lean oil is boiled therein with an external heat source (not shown, denoted with Q1), and the boiling liquid-vapor mixture is recycled into the fractionator via re-boiler recycling pipe 67*b*.

The purified regenerated lean oil re-enters the lower second group of channels via recycling hot lean oil discharge pipe 72 as described above. When leaving the fractionator via the recycling lean oil outlet pipe 72*a*, the recycling lean oil is still hot enough for heating the cold rich oil in the lower flexible deethanizer section 55. The recycling hot lean oil is first sent into an interim heater 73 to receive an extra amount of heat Q2 provided by an external heat source (not shown) to makeup the energy balance required in different operation conditions. Then the reheated hot lean oil, boosted with the lean oil transfer pump 74, is split into two streams. The bulk stream is sent via the lean oil inlet pipe 59 into the lower section of the flexible rich oil deethanizer 55 to heat the down-flowing cold rich oil. The cooled recycling lean oil leaves the lower deethanizer section via recycling lean oil outlet pipe 59*a*. The minor stream, regulated with the recycling lean oil regulation valve 33, is sent via the recycling lean oil pipe 32 into the flexible condensate deethanizer 30.

The cooled recycling lean oil flowing inside the recycling lean oil outlet pipe 59*a* is split into two streams. The bulk stream is sent to the rich oil pre-demethanizer 45, via cold recycling lean oil inlet pipe 49, to be further deep-cooled. The minor stream, regulated with the loop regulation valve 68, is sent via the loop inlet pipe 70 as the heat transport medium of the energy integration loop between the upper rich oil fractionator section 66*a* and the lower rich oil deethanizer section 55.

In the upper fractionators section 66*a*, the temperature of the NGL vapor is still high, very close to the bottom temperature of the lower flexible deethanizer section 55. The NGL vapor needs to be cooled before compressed and liquefied as the final NGL product. Significant amount of heat energy in the hot NGL vapor could be utilized to heat the rich oil in the flexible deethanizer. For this purpose, an energy-integration loop is installed to transport the available heat energy from the hot NGL vapor to the flexible deethanizer. The energy-integrated loop comprises the following elements: the loop regulation valve 68, the loop booster pump 69, the loop inlet pipe 70, the upper second group of flow channels (shown as bold dotted line), and the loop outlet pipe 70*a*. A portion of the cold recycling lean oil is diverted from the recycling lean oil outlet pipe 59*a* via the loop regulation valve 68, boosted with the loop booster pump 69, and flows via loop inlet pipe 70 into the upper second group of channels of the upper fractionator section 66*a*. The cold recycling lean oil cools the up-flowing hot NGL vapor in said upper fractionator section. The heated recycling lean oil then leaves via the loop outlet pipe 70*a*, merges with the other stream of hot recycling lean oil coming from recycling lean oil outlet pipe 72*a*, and enters the interim heater 73.

In summary, the recycling hot lean oil is used as the heating medium to provide heat to a number of energy-intensive components, including: (1) the lower section of fractionators 66; (2) the lower section of flexible rich oil deethanizer 55; (3) the rich oil pre-demethanizer 45; (4) the condensate pre-demethanizer 35; (5) the flexible condensate deethanizer 30. This is another important measure of the full energy integration of the present invention.

The final step is to liquefy the NGL vapor into the liquid NGL product.

The cooled NGL vapor, left the upper fractionator section 66*a* via the NGL vapor outlet pipe 75, enters the NGL vapor pre-cooler 76 and is further cooled with cooling water (or ambient air), coming via water inlet pipe 77 and leaving via water outlet pipe 77*a*. The lean oil vapor condensate, if any, returns via reflux pipe 75*a* into the upper fractionator section 66*a*. The water-cooled NGL vapor, compressed with the NGL vapor compressor 78 to a higher pressure, is then sent to a T-joint mixer 79 to mix with the deep-cooled NGL condensate, coming from the deep-cooled condensate pipe 36 via the condensate de-pressurization valve 37. The mixing of the compressed NGL vapor with the deep-cooled condensate would greatly decrease the liquefaction pressure. The NGL vapor-condensate mixture is sent into the NGL liquefier 38 via NGL mixture pipe 80. The mixture is cooled therein with the cooling water (or ambient air), entering via water inlet pipe 81*a* and leaving via water outlet pipe 81. The liquefied final NGL product, boosted with the booster pump 82, is delivered as final NGL product via NGL product delivery pipe 83.

The mixing of the deep-cooled NGL condensate with the compressed NGL vapor to reduce the compressor power is another important measure of the full energy integration of the present invention.

To make the FIRA process more efficient and economic in the embodiment as illustrated in FIG. 1, high performance integrated exchanger-reactors are used in the following critical components, including: the flexible condensate deethanizer 30, the flexible rich oil deethanizer 55/55*a*, and the rich oil fractionator 66/66*a*. These integrated exchanger-reactors could simultaneously perform the required mass- and heat-transfer functions in a single compact component with higher thermo-dynamic and mass-transfer efficiency. As compared with the traditional discrete configuration comprising of a tower coupling with several side-reboilers, the integrated configuration has a number of additional merits, such as significant compactness, skid-mounted capability, simplified field installation, and lower costs. It should also be recognized, however, that the discrete configuration comprising of a tower coupling with several side-reboilers is equally applicable in the FIRA process with excellent flexibility and significant energy savings as compared with both the traditional ROA process and the Cryogenic process.

Furthermore, the exceptional flexibility of the FIRA process of this invention could also give much freedom of selecting and combining a few steps of the typical FIRA process to meet particular production objectives and/or to retrofit exiting gas processing plants for enhancing their performance. For example, the following combinations of selected steps of the process could provide an excellent simplified process for an independent gas processing facility:

(1) An independent refrigeration dehydration process comprising the following FIRA steps: (a) pre-dehydrating the inlet raw gas, and (b) separating the partial NGL condensate, if any. Such a dehydration facility could produce valuable NGL by-product in addition to the advantage of the elimination of BTEX emission from the traditional glycol dehydrators.

(2) An independent flexible straight refrigeration separation process with high efficiency and low operation costs comprising the following FIRA steps: (a) pre-cooling and pre-dehydrating the raw gas with the recycling deep-cooled residue gas and the recycling deep-cooled NGL product; (b) deep-cooling the gas with an refrigerant to get the deep-dehydrated gas and deep-cooled NGL condensate; (c) removing all the methane content from the deep-cooled NGL condensate and simultaneously reduce the ethane contend therein to any desirable level to get the deep-cooled NGL product.

Figure 2:
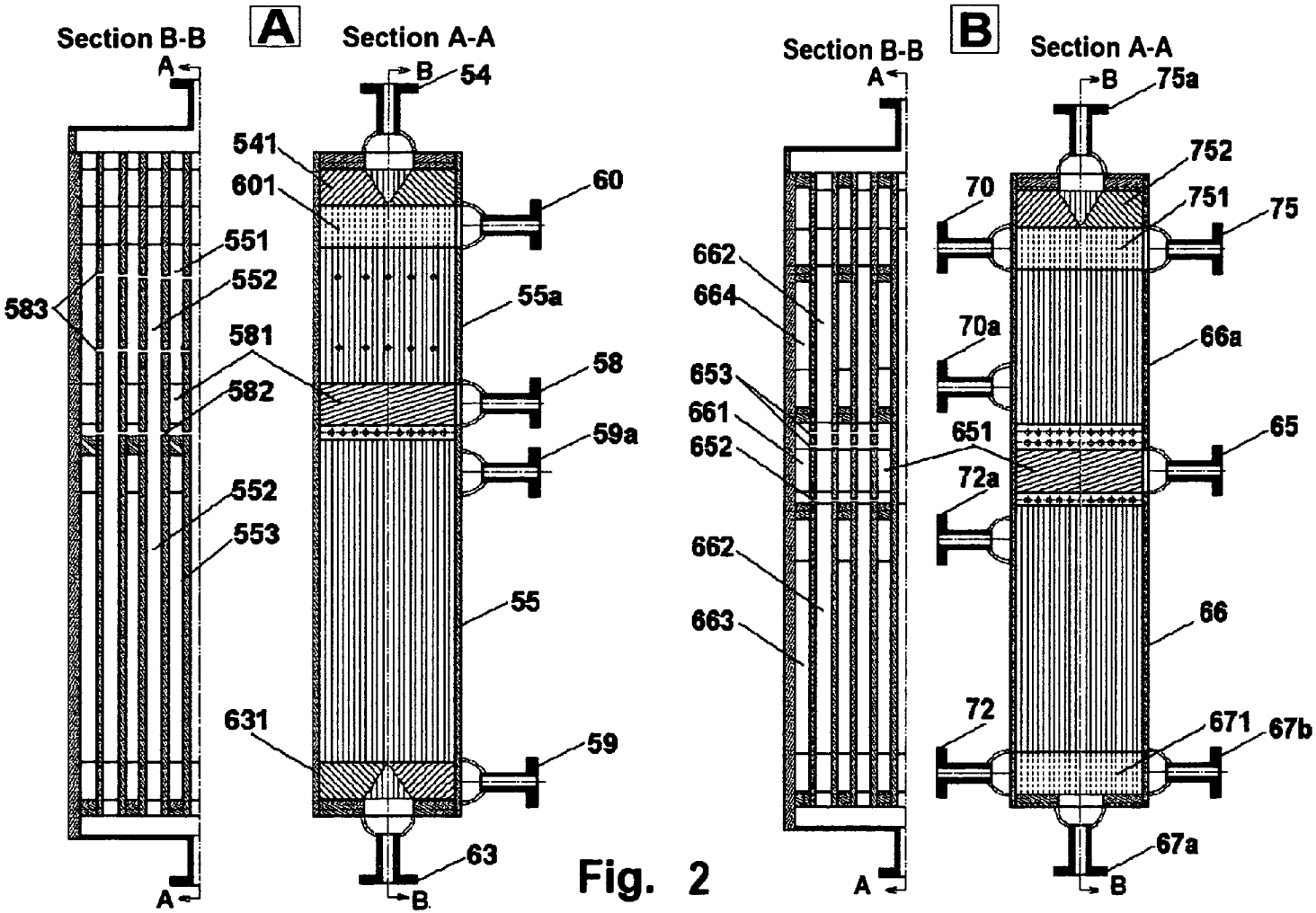
FIG. 2 illustrates examples of the high-performance dual-function exchanger-reactors used in FIG. 1 for carrying out heat- and mass-transfer simultaneously in critical components.

FIG. 2 illustrates examples of the high-performance dual-function exchanger-reactors used in FIG. 1 for carrying out heat- and mass-transfer simultaneously in critical components.

One of the outstanding merits of the present invention is the use of the high-efficiency, compact dual-function exchanger-reactor for simultaneous heat- and mass-transfer in critical components, such as the flexible NGL condensate deethanizer 30, the flexible rich oil deethanizer 55/55*a*, and the fully energy-integrated purified rich oil fractionator 66/66*a*.

Although the exchanger-reactors have already been widely used in other chemical industries for years, the application to gas processing industry is still very limited. Specific requirements for gas processing present new challenge to current exchanger-reactor design.

The exchanger-reactors used in present invention could be classified roughly into two categories: the flexible deethanizer wherein the upper section is a stripper and the lower section an evaporator with intensive heat duty; and the fractionator wherein the upper section is a heat exchanger and the lower section a distiller with an external heat source. The key issue in such exchanger-reactor design is the generation and maintenance of a continuous, thin liquid film covering enormous surface of tens of thousands narrow flow channels within a compact exchanger-reactor. The innovative solution follows.

FIG. 2A illustrates one preferred embodiment of the plate-fin type exchanger-reactor applicable to the flexible rich oil deethanizer. Section A-A illustrates the general layout of various groups of flow channels therein. Section B-B illustrates the detailed internal configuration of these groups of flow channels.

The configuration of the flexible deethanizer is similar to an upright multi-stream plate-fin heat exchanger, comprising of an upper section 55*a*, and a lower section 55. As shown in Section B-B, there are three groups of narrow flowing channels, i.e. the main group of channels 552, extending from the top to the bottom of entire deethanizer, the upper group of channels 551, inside the upper section of the deethanizer, and the lower group of channels 553, inside the lower section of the deethanizer. The different groups of channels are separated with parting sheets and spacing bars as the conventional plate-fin heat exchanger.

The depressurized pre-demethanized rich oil, a mixture of NGL vapor and liquid rich oil, enters the bottom of the upper group of channels 551 of the rich oil deethanizer, via rich oil mixture inlet pipe 58, at the junction between the lower and upper deethanizer sections, 55 and 55*a*. The vapor and liquid are separated therein with a special perforated fin separator 581. The separated rich oil liquid flows downward and passes through numerous small horizontal pinholes 582 on the parting sheets between the upper group of channels 551 and the main group of channels 552. The liquid then flows downward as thin liquid film covering the entire surface of the lower part of the main group of channels.

In the lower section of the deethanizer, the down-flowing liquid film is heated with the hot recycling lean oil flowing up in the lower group of channels 553, coming via the recycling lean oil inlet pipe 59 and leaving via the recycling lean oil outlet pipe 59*a*. The residue gas, evaporated from the heated rich oil film, flows upward in the main group of channels 552 and, at the same time, is continuously stripped with the colder down-flowing liquid film. Trace of the heaviest hydrocarbon vapor is re-absorbed with the liquid film and carried down to the bottom.

In the upper section of the deethanizer, a stream of deep-cooled stripping lean oil is introduced via stripping lean oil inlet pipe 54 and distributed with the distribution section 541 into both group of channels 551 and 552. The stripping lean oil flows downward as thin liquid film covering the entire surface of both group of channels 551 and 552. The residue gas, flowing up in both group of channels 551 and 552, is stripped with the down flowing lean oil film to remove the heaviest hydrocarbons components as well as the desired ethane content therein. Numerous horizontal pinholes 583 are provided on the parting sheets of the upper section of the deethanizer to equalize the vapor and liquid flowing inside both group of channels 551 and 552. At the bottom of the upper section of the deethanizer, the portion of the stripping liquid film flowing inside flow channel group 551 passes through the horizontal pinholes 582 and merges into the group channels 552. On the other hand, the residue gas, flowing to the top of the deethanizer, penetrates the falling liquid film via numerous pores of the special gas-liquid separation section 601 and leaves the deethanizer via the residue gas outlet pipe 60.

By adjusting the molar ratio of the stripping lean oil vs. residue gas, as well as the bottom temperature of the deethanizer, the ethane recovery rate could be controlled to any desirable value between >95% and <2%. The purified rich oil product with the desired ethane content is eventually discharged via the distribution section 631 and the purified rich oil outlet pipe 63.

FIG. 2B illustrates one preferred embodiment of the plate-fin type exchanger-reactor applicable to the flexible rich oil fractionator. Section A-A illustrates the general layout of various groups of flow channels therein. Section B-B illustrates the detailed internal configuration of these groups of flow channels.

The configuration of the flexible fractionator is similar to an upright multi-stream plate-fin heat exchanger, comprising of an upper section 66*a* and a lower section 66. As shown in Section B-B, there are four groups of narrow flowing channels, i.e. the main group of channels 662, extending from the top to the bottom of entire fractionator; the upper group of channels 664, inside the upper section of the fractionator; the lower group of channels 663, inside the lower section of the fractionator, and the middle group of channels 661, between the upper and the lower group of channels. The different groups of channels are separated with parting sheets and spacing bars as the conventional plate-fin heat exchanger.

The depressurized purified rich oil, a mixture of NGL vapor and liquid rich oil, enters the middle group of channels 661 of the rich oil fractionator, via purified rich oil mixture inlet pipe 65, at the junction between the lower and upper sections, 66 and 66*a*. The vapor and liquid are separated therein with a special perforated fin separator 651. The separated liquid flows downward and passes through numerous small horizontal pinholes 652 on the parting sheets between the middle group of channels 661 and the main group of channels 662. The liquid then flows downward as thin liquid film covering the entire surface of the lower part of the main group of channels.

In the lower section of the fractionator, the down-flowing liquid film is heated with the hot recycling lean oil flowing up in the lower group of channels 663, coming via the recycling lean oil inlet pipe 72 and leaving via the recycling lean oil outlet pipe 72*a*. The residue gas, evaporated from the heated rich oil film, mixed with the recycling NGL-lean oil vapor coming from the re-boiler recycling pipe 67*b* through the lower special perforated fin separator 671, flows upward in the main group of channels 662 and, at the same time, is continuously stripped with the colder down-flowing liquid film. Trace of the heaviest hydrocarbon vapor is re-absorbed with the liquid film and carried down to the bottom.

On the other hand, the NGL vapor of the inlet NGL mixture, separated in the special perforated fin separator 651, passes horizontally through numerous small pinholes 653 on the parting sheets into the main group of channels 662 and merges with the NGL vapor flowing up from the lower part of the same group of channels. Since the mixed NGL vapor is still rather hot, it is cooled with the down-flowing cold lean oil in the upper group of channels 664, coming via loop inlet pipe 70 and leaving via loop outlet pipe 70*a*. The tiny amount of lean oil vapor condensed on the surfaces of the group channels 662 flows down to the junction between the upper and lower sections of the fractionator and merges with the input liquid purified rich oil.

The cooled NGL vapor, on the other hand, flows to the top, passes through the upper special perforated fin separator 751, and leaves the fractionator via NGL vapor outlet pipe 75. The lean oil liquid condensed in external water cooler 76 (not shown here, ref. FIG. 1) returns as a reflux into the fractionator via the reflux pipe 75*a*. The reflux is distributed via the distribution section 752 into the main group of channels 662. The in-flow reflux is separated from the out-flow NGL vapor in the upper special perforated fin separator 751.

At the bottom of the fractionator, the very hot regenerated lean oil is eventually discharged via the lower special perforated fin separator 671 and the lean oil discharge pipe 67*a* to the external re-boiler 67 (not shown here, ref. FIG. 1) for final purification.

It will be recognized that, based on similar principles as described in this section, other designs of exchanger-reactor could also perform simultaneous heat- and mass-transfer functions in FIRA process as well.

Figure 3:
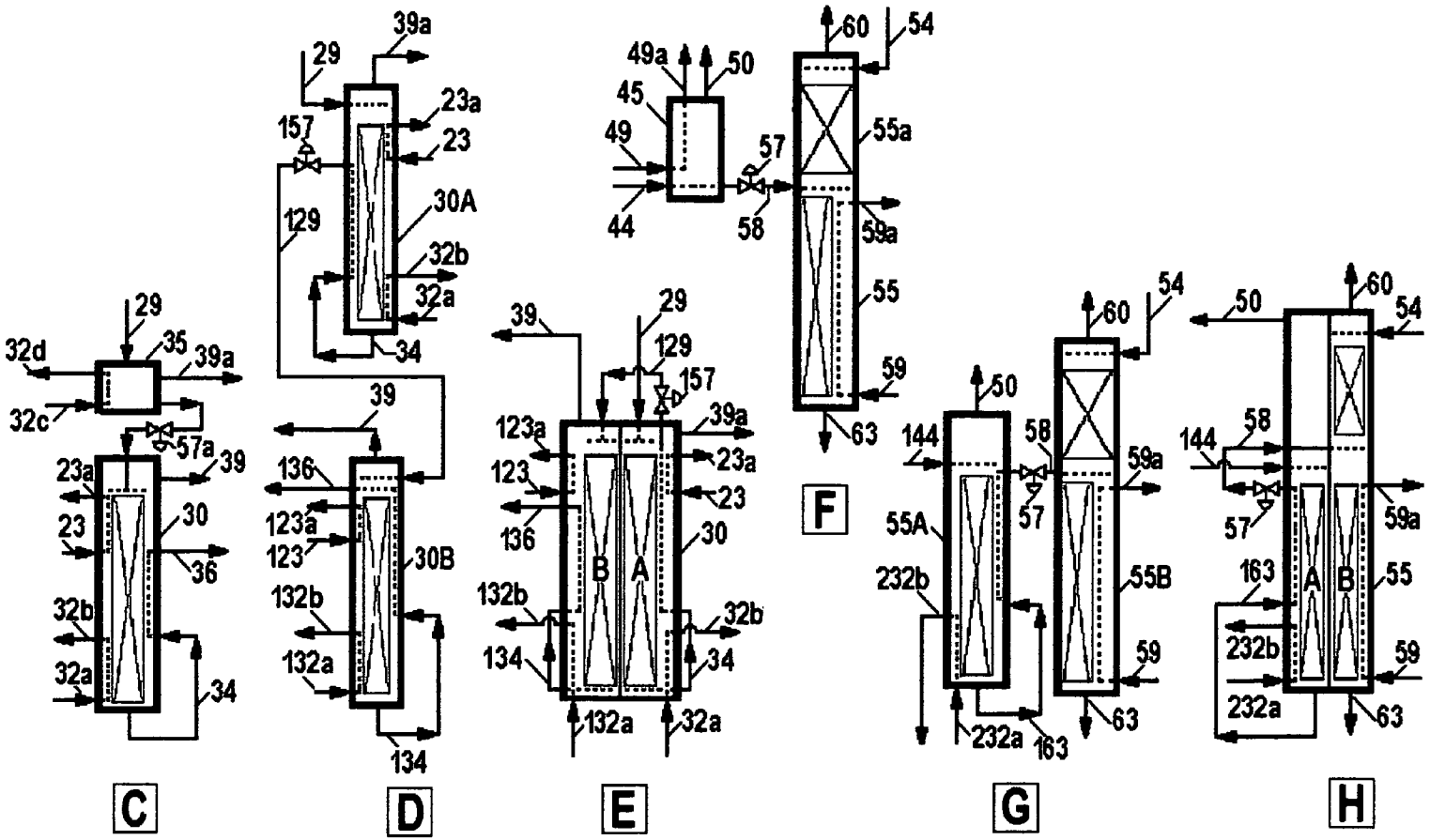
FIG. 3 illustrates the embodiments of the high-performance cascade flexible deethanizer that could replace the combination of a pre-demethanizer and a flexible deethanizer in tandem as illustrated in FIG. 1 for purifying NGL condensate and rich oil.

FIG. 3 illustrates the embodiments of the high-performance cascade flexible deethanizer that could replace the combination of a pre-demethanizer and a flexible deethanizer in tandem as illustrated in FIG. 1 for purifying NGL condensate and rich oil.

The innovative application of exchanger-reactor in present invention makes possible to develop the more efficient and energy-saving cascade flexible deethanizers for purifying both NGL condensate and rich oil as illustrated in FIG. 3.

FIGS. 3-C through 3-E illustrate the evolution and the principle of the cascade flexible deethanizers for NGL condensate purification.

FIG. 3-C is the original flow diagram comprising of the combination of a condensate pre-demethanizer and a flexible condensate deethanizer in tandem as illustrated in FIG. 1.

The deep-cooled NGL condensate, under the high pressure of the flexible absorber 28 (not shown here, ref. FIG. 1), enters the pre-demethanizer 35 via the NGL condensate outlet pipe 29. The high pressure deep-cooled condensate is heated with the recycling hot lean oil, coming via the lean oil inlet pipe 32*c* and leaving via the lean oil outlet pipe 32*d*. A substantial portion of the condensed methane, together with a small portion of ethane and trace of higher hydrocarbons, is evaporated as the residue gas and sent back to the absorber via the residue gas outlet pipe 39*a*. The pre-methanized condensate is then de-pressurized with the condensate de-pressurization valve 57*a* to a lower pressure and further purified in the flexible condensate deethanizer 30.

In the flexible condensate deethanizer 30, the de-pressurized condensate flows inside the first group of channels (shown as a thin-lined rectangular block). The condensate is first deep-cooled with the refrigerant flowing inside the second group of channels, shown as a bold dotted line, coming via the refrigerant inlet pipe 23 and leaving via the refrigerant outlet pipe 23*a*. Then the condensate is pre-heated with the recycling hot purified condensate flowing inside the third group of channels, shown as a bold dotted line, coming via the recycling condensate inlet pipe 34 and leaving via the deep-cooled NGL condensate pipe 36, and eventually heated with the recycling hot lean oil flowing inside the fourth group of channels, shown as a bold dotted line, coming via lean oil inlet pipe 32*a* and leaving via lean oil outlet pipe 32*b*. The bottom temperature of the deethanizer is controlled according to the desired level of ethane content. The final purified condensate is discharged from the bottom via recycling condensate inlet pipe 34 and returned to the deethanizer to pre-heat the cold condensate as described above. The recycling condensate is deep-cooled and eventually discharged via deep-cooled NGL condensate pipe 36. The residue gas is sent via residue gas outlet pipe 39 to the rich oil deethanizer 55 (not shown here, ref. FIG. 1).

FIG. 3-D illustrates the new cascade flexible condensate deethanizing process comprising two similar deethanizer stages in tandem to replace the original embodiment illustrated in FIG. 3-C. The high-pressure deep-cooled NGL condensate is directly sent into the first stage of deethanizer 30A. The configuration of the first stage of deethanizer is similar to the original deethanizer 30 illustrated in FIG. 3-C, but operating under the same high pressure as the original pre-demethanizer 35.

In the first stage of new cascade flexible rich oil deethanizer 30A, the high pressure rich oil enters via the condensate inlet pipe 29 and flows inside the first group of channels (shown as a thin-lined slender rectangular block). The high-pressure condensate is first deep-cooled with the refrigerant flowing inside the second group of channels, shown as a bold dotted line, coming via the refrigerant inlet pipe 23 and leaving via the refrigerant outlet pipe 23*a*. Then the condensate is pre-heated with the recycling hot semi-purified condensate flowing inside the third group of channels, shown as a bold dotted line, coming via the recycling semi-purified condensate inlet pipe 34 and leaving via the deep-cooled semi-purified condensate transfer pipe 129; and eventually the condensate is heated with the recycling hot lean oil flowing inside the fourth group of channels, shown as a bold dotted line, coming via lean oil inlet pipe 32*a* and leaving via lean oil outlet pipe 32*b*. The bottom temperature of the first stage deethanizer is controlled according to the desired level of ethane content. The semi-purified condensate is discharged from the bottom via recycling condensate inlet pipe 34 and returned to the first stage deethanizer to pre-heat the cold condensate as described above. The recycling semi-purified condensate is deep-cooled and eventually flows via the de-pressurization valve 157 and the semi-purified condensate transfer pipe 129 into the second stage deethanizer 30B. The residue gas is sent out via the residue gas outlet pipe 39*a* to the absorber 28 (not shown here, ref FIG. 1).

The working pressure and the bottom temperature of the second stage deethanizer 30B depend on the partial deethanization level required. Should very high ethane recovery rate be required (i.e., no ethane-rejection), the high-pressure semi-purified condensate would be directly sent into the second stage deethanizer, without de-pressurization, for complete demethanization. Otherwise adequate depressurization is required: the pressure depends on the desirable level of the partial deethanization. The de-pressurized condensate, flashed into a vapor-liquid mixture, is sent into the second stage deethanizer and is separated therein.

In the second stage deethanizer 30B, the liquid portion of the mixture flows inside the first group of channels (shown as a thin-lined slender rectangular block). The semi-purified condensate is first deep-cooled with the refrigerant flowing inside the second group of channels, shown as a bold dotted line, coming via the refrigerant inlet pipe 123 and leaving via the refrigerant outlet pipe 123*a*. Then the semi-purified condensate is pre-heated with the recycling hot purified condensate flowing inside the third group of channels, shown as a bold dotted line, coming via the recycling purified condensate inlet pipe 134 and leaving via the deep-cooled purified condensate pipe 136; and eventually the semi-purified condensate is heated with the recycling hot lean oil flowing inside the fourth group of channels, shown as a bold dotted line, coming via lean oil inlet pipe 132*a* and leaving via lean oil outlet pipe 132*b*. The semi-purified condensate, flowing to the bottom, is processed into the purified condensate discharged via recycling purified condensate inlet pipe 134 and returns to the second stage deethanizer to pre-heat the cold condensate as described above. The recycling purified condensate is eventually deep-cooled and discharged via deep-cooled purified condensate pipe 136. The residue gas is sent via residue gas outlet pipe 39.

FIG. 3-E illustrates the integrated cascade flexible condensate deethanizer for NGL condensate purification.

To simplify the system and make the new embodiment more compact, the two stages of cascade condensate deethanizer could be constructed as a single integrated exchanger-reactor incorporating both 30A and 30B as illustrated in FIG. 3-E. Since all the numbers of relevant elements and the flow procedures in FIG. 3-E are identical to those described in FIG. 3-D, no redundant explanation is needed.

FIGS. 3-F through 3-H illustrate the evolution and the principle of the flexible cascade flexible deethanizer for rich oil purification.

FIG. 3-F is the original flow diagram comprising of the combination of a rich oil pre-demethanizer and a flexible rich oil deethanizer in tandem as illustrated in FIG. 1.

The deep-cooled rich oil, under the high pressure of the flexible absorber, 28 (not shown here, ref. FIG. 1), enters the pre-demethanizer 45 via the rich oil inlet pipe 44. The high pressure deep-cooled rich oil is heated with the recycling lean oil coming via cold recycling lean oil pipe 49 and leaving via deep-cooled recycling lean oil pipe 49*a*. A substantial portion of the absorbed methane, together with a small portion of ethane and trace of higher hydrocarbons, is evaporated from the deep-cooled rich oil as the residue gas and sent back to the absorber via the residue gas transfer pipe 50. The pre-demethanized rich oil is then flashed with the condensate de-pressurization valve 57 into a rich oil liquid-vapor mixture that flows via rich oil mixture inlet pipe 58 into the flexible rich oil deethanizer at the junction of the upper and lower section of the deethanizer, 55/55*a*.

The rich oil liquid-vapor is separated inside the flexible rich oil deethanizer. In the lower section of the deethanizer 55, the liquid rich oil flows downward as liquid film covering the channel wall of the first group of channels (shown as a thin-line slender rectangular block). The liquid rich oil is heated with the up-flowing recycling hot lean oil flowing inside the second group of channels, shown as a bold dotted line, coming via recycling lean oil inlet pipe 59 and leaving via recycling lean oil outlet pipe 59*a*. All the dissolved methane and a desirable portion of ethane are evaporated as the residue gas. The purified rich oil, containing adequate ethane content and all other heavier hydrocarbons, is discharged from the bottom via purified rich oil outlet pipe 63. The residue gas, on the other hand, flowing upward into the upper section, 55*a*, is stripped with the deep-cooled lean oil coming via the stripping lean oil inlet pipe 54 and sent out via residue gas outlet pipe 60.

FIG. 3-G illustrates the new cascade flexible rich oil deethanizing process comprising two similar deethanizer stages in tandem to replace the original embodiment as illustrated in FIG. 3-F. The high-pressure deep-cooled rich oil is directly sent into the first stage of rich oil deethanizer, 55A. The configuration of the first stage of rich oil deethanizer is similar to the lower section of the original rich oil deethanizer 55 illustrated in FIG. 3-F, but operating under the same high pressure as the original rich oil pre-demethanizer 45.

In the first stage of rich oil deethanizer 55A, the high-pressure rich oil enters via the rich oil inlet pipe 144, flowing as liquid film covering the channel wall of the first group of channels (shown as a thin-lined slender rectangular block). The rich oil is first pre-heated with the hot recycling semi-purified rich oil flowing inside the second group of channels, shown as a bold dotted line, coming via the recycling semi-purified rich oil inlet pipe 163 and leaving via the deep-cooled semi-purified condensate transfer pipe 58, and then heated with the recycling hot lean oil flowing inside the third group of channels, shown as a bold dotted line, coming via lean oil inlet pipe 132*a* and leaving via lean oil outlet pipe 132*b*. The bottom temperature of the first stage rich oil deethanizer is controlled according to the desired level of ethane content. The final semi-purified rich oil is discharged from the bottom via recycling semi-purified rich oil pipe 163, and returns to the first stage rich oil deethanizer to pre-heat the cold rich oil as described above. The recycling semi-purified rich oil is deep-cooled therein and then flows via the semi-purified rich oil de-pressurization valve 57 and the semi-purified rich oil transfer pipe 58 into the second stage rich oil deethanizer 55B. The residue gas is discharged via residue gas transfer pipe 50.

The working pressure and its bottom temperature of the second stage rich oil deethanizer 55B depend on the desired deethanization level. Should very high ethane recovery rate be required (i.e., no ethane-rejection), the high-pressure semi-purified condensate would be sent directly into the second stage rich oil deethanizer, without de-pressurization, for complete demethanization. Otherwise adequate depressurization is required: the pressure depends on the desired ethane level of the purified rich oil. The de-pressurized condensate, flashed into a vapor-liquid mixture, is sent into the second stage rich oil deethanizer and is separated therein.

The liquid portion of the mixture flows as liquid film covering the channel wall of the first group of channels (shown as a thin-lined slender rectangular block). Then the semi-purified rich oil is heated with the recycling hot lean oil flowing inside the second group of channels, shown as a bold dotted line, coming via lean oil inlet pipe 59 and leaving via lean oil outlet pipe 59*a*. The purified rich oil is discharged via purified rich oil outlet pipe 63.

On the other hand, all the methane and a desirable portion of ethane, evaporated as the residue gas, flows into the upper section of the second stage deethanizer, and contacts with the stripping lean oil coming via the stripping lean oil inlet pipe 54. The stripped residue gas is discharged via the residue gas outlet pipe 60.

FIG. 3-H illustrates the integrated cascade flexible condensate deethanizer for rich oil purification.

To simplify the system and make the new embodiment more compact, the two stages of cascade condensate deethanizer could be constructed as a single integrated exchanger-reactor incorporating both 55A and 55B as illustrated in FIG. 3-H. Since all the numbers of relevant elements and the flow procedures in FIG. 3-H are identical to those described in FIG. 3-G, no redundant explanation is needed.

The advantages of the high performance cascade flexible deethanizer described above are best demonstrated with the comparison of the simulation results of the new configuration FIG. 3-G and the original one (FIG. 3-F).

TABLE 1

Comparison of Flexible Rich Oil Deethanizer Simulation Results (Unit: lb-mol/hr for 100 MMscfd input)

| Stream No. | P, psia | T, ° F. | C1 | C2 | C3 | C4+ | C10 |
|---|---|---|---|---|---|---|---|
| Original Case (FIG. 3-F): No Ethane-rejection, 95% C2 Recovery | | | | | | | |
| 44 (Inlet) | 890 | −40 | 3118.51 | 1336.47 | 550.21 | 437.72 | 1735.68 |
| 50 | 890 | 40 | 1788.37 | 324.55 | 55.59 | 16.66 | 0.29 |
| 58 | 450 | 32 | 1330.14 | 1011.56 | 494.56 | 421.05 | 1735.39 |
| 54 | 450 | −40 | 0 | 0 | 0.06 | 2.09 | 1097.85 |
| 60 | 450 | −29.6 | 1319.14 | 2.91 | 0 | 0 | 0 |
| 63 (Outlet) | 450 | 261.7 | 11.00 | 1008.65 | 494.62 | 423.14 | 2833.24 |
| Cascade Case (FIG. 3-G): No Ethane-rejection, 95% C2 Recovery | | | | | | | |
| 144 (Inlet) | 890 | −40 | 3118.51 | 1336.47 | 550.21 | 437.72 | 1735.68 |
| 50 | 890 | −40 | 3021.50 | 224.97 | 25.73 | 6.73 | 0.04 |
| 163 | 890 | 344.6 | 96.99 | 1111.50 | 524.48 | 430.99 | 1735.64 |
| 58 | 890 | −40 | 96.99 | 1111.50 | 524.48 | 430.99 | 1735.64 |
| 54 | 890 | −40- | 0 | 0 | 0 | 0 | 0 |
| 60 | 890 | −12 | 88.59 | 9.90 | 1.19 | 0.32 | 0.01 |
| 63 (Outlet) | 890 | 393 | 8.04 | 1101.60 | 523.29 | 430.66 | 1735.63 |
| Original Case (FIG. 3-F): Max. Ethane-rejection, 2% C2 Recovery | | | | | | | |
| 44 (Inlet) | 890 | −40 | 2328.74 | 904.16 | 581.74 | 454.05 | 301.23 |
| 50 | 890 | 40 | 1585.70 | 326.48 | 102.71 | 34.50 | 0.17 |
| 58 | 450 | 32 | 743.04 | 577.68 | 479.03 | 419.55 | 307.06 |
| 54 | 450 | −40 | 0 | 0 | 0.02 | 3.19 | 346.79 |
| 60 | 450 | 38.4 | 743.52 | 555.96 | 9.49 | 0.55 | 0.08 |
| 63 (Outlet) | 450 | 315.8 | Trace | 22.00 | 456.71 | 422.07 | 647.76 |
| Cascade Case (FIG. 3-G): Max. Ethane-rejection, 2% C2 Recovery | | | | | | | |
| 144 (Inlet) | 890 | −40 | 2328.74 | 904.16 | 581.74 | 454.05 | 301.23 |
| 50 | 890 | 40 | 2304.71 | 186.47 | 38.48 | 0.39 | 0.02 |
| 163 | 890 | 32 | 24.03 | 717.69 | 543.26 | 443.67 | 301.21 |
| 58 | 700 | −40 | 24.03 | 717.69 | 543.26 | 443.67 | 301.21 |
| 54 | 700 | −40 | 0 | 0 | 0.02 | 3.15 | 250 |
| 60 | 700 | 121.7 | 24.03 | 696.43 | 10.55 | 0.87 | 1.28 |
| 63 (Outlet) | 700 | 400.1 | Trace | 21.26 | 532.73 | 445.95 | 549.93 |

It is obvious in Table 1 that the advantages of the new cascade flexible deethanizer are: (1) for high ethane recovery, no ethane-rejection (95% C2 recovery), complete demethanization could be carried out in new cascade process under higher pressures and the residue gas need no recompression; (2) for high ethane recovery, no ethane-rejection (95% C2 recovery), complete demethanization could be carried out in new cascade process without stripping lean oil; (3) maximum ethane-rejection process (2% C2 recovery) could be carried out with lesser residue gas under higher pressure and as compared with the original process, and, hence, with much less residue gas recompression power; and (4) maximum ethane-rejection process (2% C2 recovery) could be carried out with much less stripping lean oil. In short, the new process provides significant operational flexibility and energy-savings.

Figure 4:
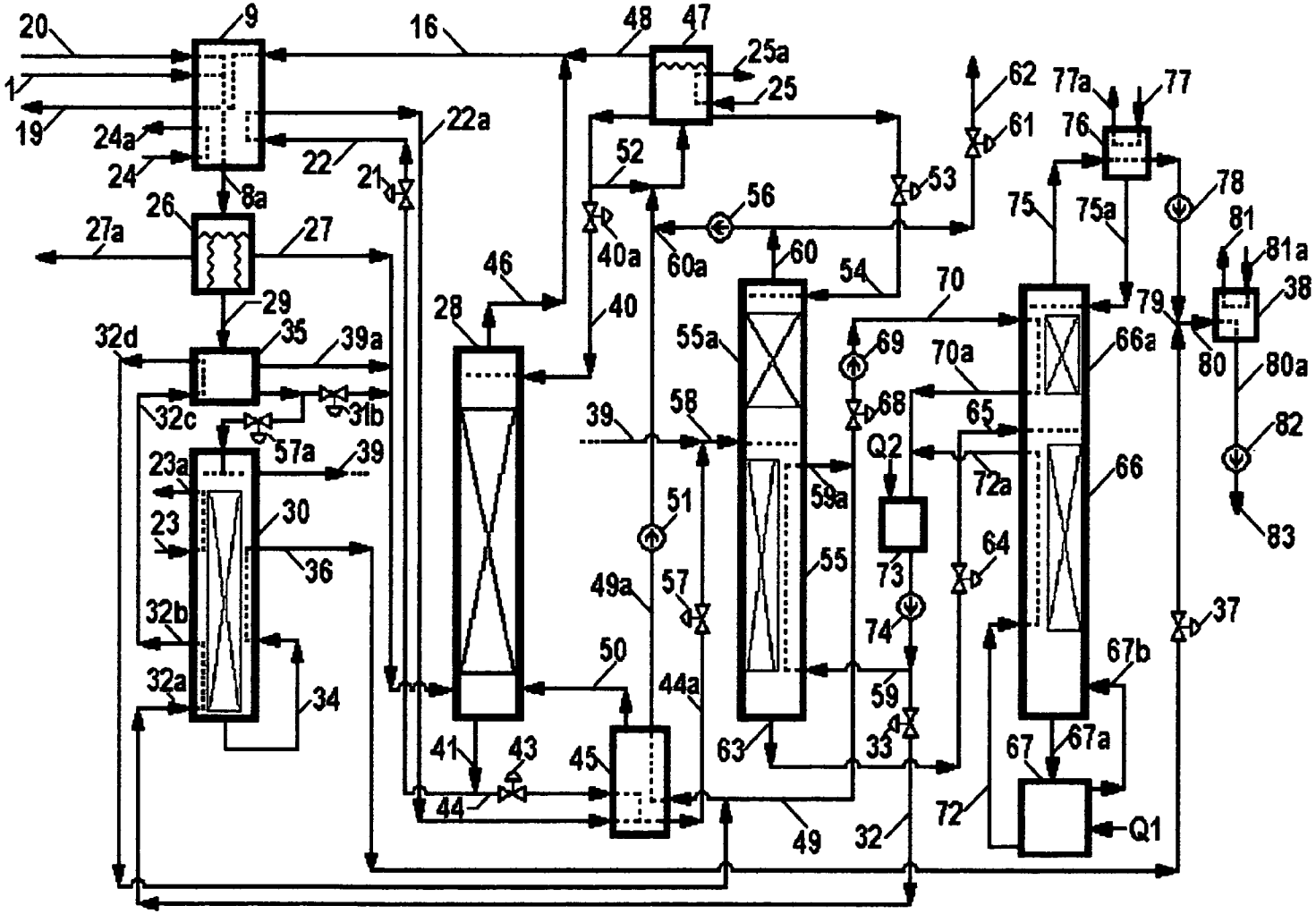
FIG. 4 illustrates another embodiment of the flexible hydrocarbon gas separation process as illustrated in FIG. 1 wherein the inlet gas has already been pre-dehydrated to pipeline gas spec.

FIG. 4 illustrates another embodiment of the flexible hydrocarbon gas separation process as illustrated in FIG. 1 wherein the inlet gas has already been pre-dehydrated to pipeline gas spec.

In case the input gas had been already dehydrated elsewhere before entering the FIRA plant, a simpler embodiment of the present invention would be preferred. Since the water content of the input gas is much lower in the present case, the dehydration section in FIG. 4 could be much simpler than the basis flow diagram as illustrated in FIG. 1. The pre-treatment and the pre-dehydration section of FIG. 1 could be eliminated, including: the primary heat exchanger 2, the moisture deparator 3, the pre-dehydrator 5, and the three-phase separator 7. The pipeline spec gas could be introduced directly to the deep-dehydrator 9 as shown in FIG. 4.

The internal structure of the deep dehydrator 9 of FIG. 4, however, would be a little complicated. The deep-cooled residue gas would be sent directly into the deep-dehydrator as the cooling medium, together with the deep-cooled rich oil and the refrigerant from the external refrigerator. A multi-stream exchanger-reactor as illustrated in FIG. 2 should be used. The configuration given by the inventor in U.S. Pat. No. 6,694,786, "Non-frost Deep-freezing Gas Dehydrator", could serve as an example. The concentrate inhibitor solution introduced via the inhibitor make-up pipe 20 would generate an inhibitor liquid film to prevent the formation of gas hydrate.

The high concentrated inhibitor solution, diluted with the water condensed, flows into the three-phase separator 26, together with the immiscible NGL condensate and the deep-dehydrated hydrocarbon gas. The three immiscible fluids are separated therein. The separated diluted inhibitor solution is then discharged via inhibitor solution discharge pipe to the external inhibitor regeneration facility not shown in the FIG. 4.

The rest elements of the flow diagram and all the operation procedures in FIG. 4 are identical to those in FIG. 1. No redundant description is needed.

Figure 5:
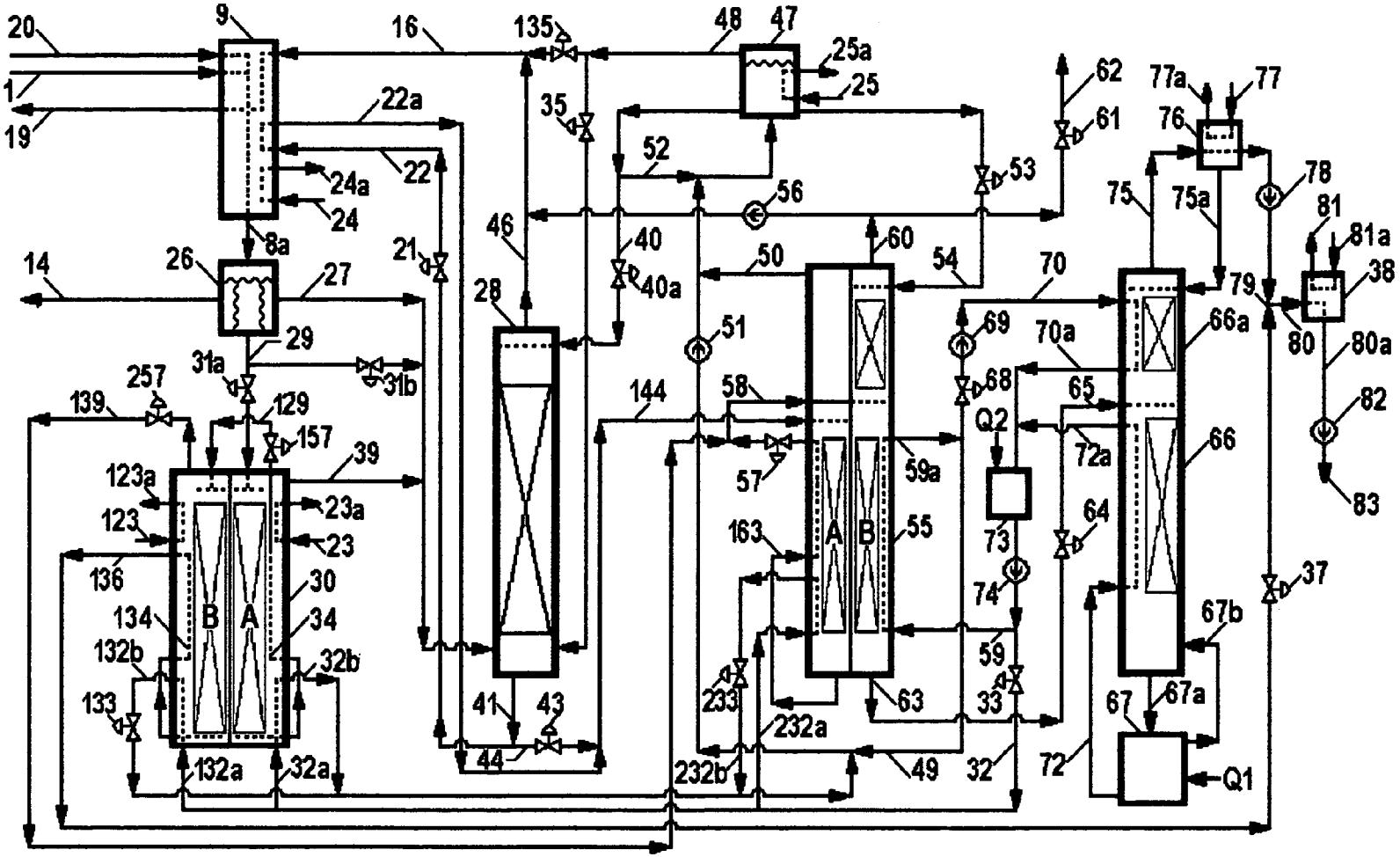
FIG. 5 illustrates an alternative embodiment of the flexible hydrocarbon gas separation process as illustrated in FIG. 4 wherein the high-performance, integrated cascade flexible deethanizers are used.

FIG. 5 illustrates an alternative embodiment of the flexible hydrocarbon gas separation process as illustrated in FIG. 4 wherein the high-performance, integrated cascade flexible deethanizers are used.

The major difference between FIG. 5 and FIG. 4 is the replacement of the combination of a pre-demethanizer and a flexible deethanizer in tandem with the integrated cascade flexible deethanizer. As already described in FIG. 3, the flexibility of the ethane-rejection operations in FIRA process could be more efficiently carried out with the high-performance, integrated cascade flexible deethanizer. Since the details of the internal configuration of the integrated cascade flexible deethanizer have already been described in FIGS. 3-E and 3-H, only the external connections of the deethanizers with other components need to be described in FIG. 5.

First, the external connections of the integrated cascade flexible NGL condensate deethanizer, 30A/30B.

There are 12 external connections as described below.

(1) The NGL discharge pipe 29 connects with the three-phase separator 26 providing deep-cooled NGL condensate stream to the first stage of the integrated flexible cascade deethanizer, 30A, via and the shift valve 31*a*. The purpose of the pair of shift valves 31*a* and 31*b* is to bypass the NGL condensate directly into the absorber 28 in case the quantity of the NGL condensate is too small, not worthy to be purified specially in the cascade deethanizer.

(2) The residue gas outlet pipe 39 connects with the cold dry gas outlet pipe 27.

(3) The residue gas outlet pipe 139 connects with the second stage of the integrated cascade flexible deethanizer, 55A, via the residue gas de-pressurization valve 257.

(4) The deep-cooled NGL condensate pipe 136 connects with the NGL liquefier 38, via the condensate depressurization valve 37.

(5) The four refrigerant inlet and outlet pipes, 23, 23*a*, 123, and 123*a*, connect with the external refrigerator not shown in FIG. 5.

(6) The four lean oil inlet and outlet pipes, 32*a*, 32*b*, 132*a*, and 132*b* connect with the hot recycling lean oil pipe 32 and the cold recycling pipe 49, respectively.

(7) The lean oil regulation valve 133 is installed to adjust the lean oil flow rates in the two stages of the deethanizer.

Secondly, the external connections of the integrated cascade flexible rich oil deethanizer, 55A/55B.

There are 9 external connections as described below.

(1) The rich oil inlet pipe 144 connecting with the flexible absorber 28 providing deep-cooled rich oil stream to the first stage of the integrated flexible cascade deethanizer, 55A. The residue gas outlet pipe 39 connects with the cold dry gas outlet pipe 27.

(2) The residue gas transfer pipe 50 connects with the cold recycling lean oil pipe 49.

(3) The residue gas outlet pipe 60 connects with the residue gas discharge pipe 46 via the residue gas compressor 56 and the fuel gas pipe 62 via the fuel gas de-pressurization valve 61.

(4) The purified rich oil outlet pipe 63 connects with the rich oil fractionator 66, via the rich oil depressurization valve 64.

(5) The stripping lean oil inlet pipe 54 connects with the lean oil pre-saturator 47, via the stripping lean oil regulation valve 53.

(6) The lean oil inlet and outlet pipes 59 and 59*a* connect with the lean oil transfer pump 74 and the cold recycling pipe 49, respectively.

(7) The lean oil inlet and outlet pipes 232*a* and 232*b* connect with the hot recycling lean oil pipe 32 and the cold recycling pipe 49, respectively. The lean oil flow rate is adjusted with the lean oil regulation valve 233.

The rest elements of the flow diagram and all the operation procedures in FIG. 5 are identical to those in FIG. 4. No redundant description is needed.

Figure 6:
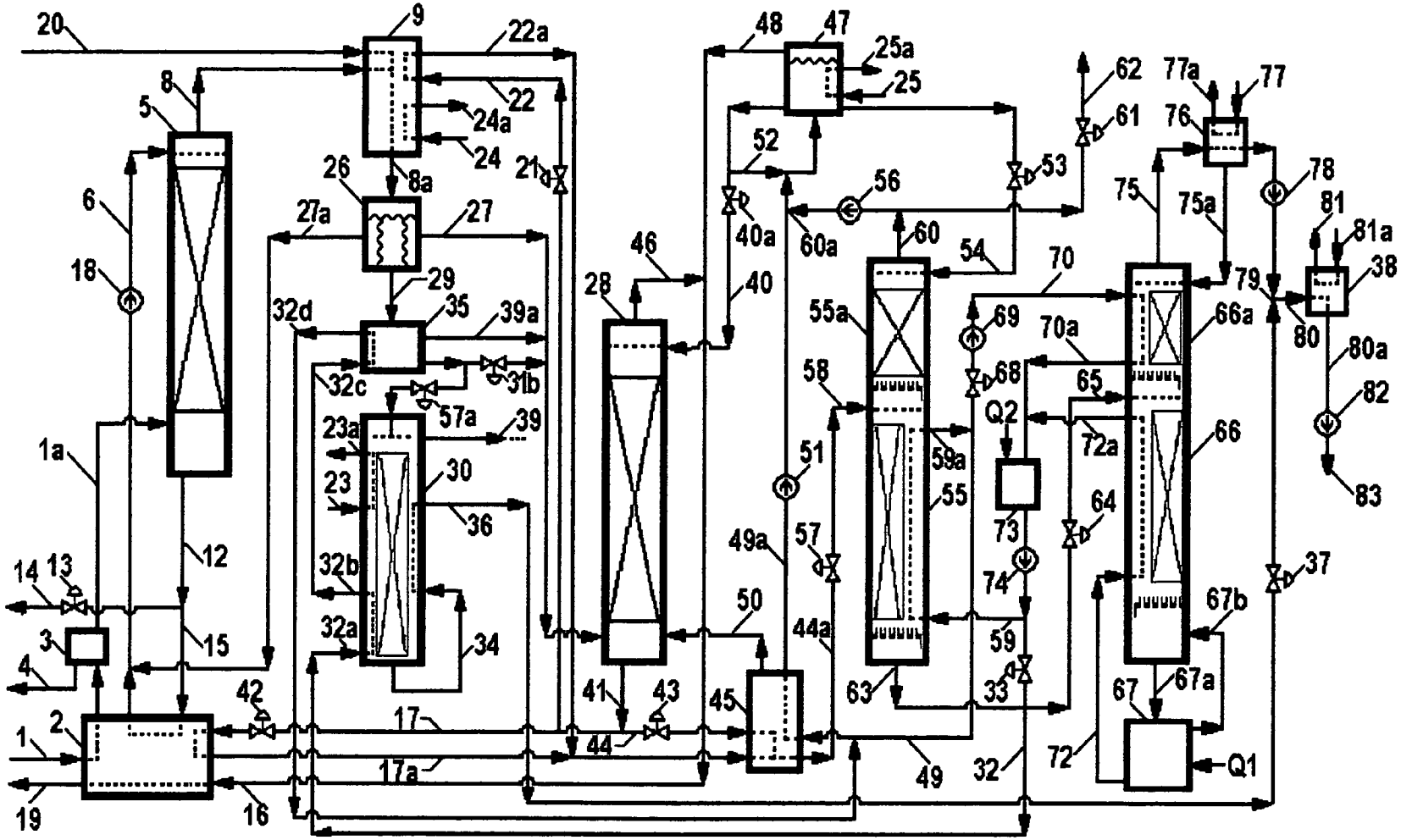
FIG. 6 illustrates still another embodiment of the flexible hydrocarbon gas separation process as illustrated in FIG. 1 wherein the temperature of the pre-cooled gas is above the NGL dew point.

FIG. 6 illustrates still another embodiment of the flexible hydrocarbon gas separation process as illustrated in FIG. 1 wherein the temperature of the pre-cooled gas is above the NGL dew point.

The NGL dew point would be lower than the temperature of the pre-cooled gas under either of the following circumstances:

(1) The richness of the higher hydrocarbons of the raw gas is so low that the NGL dew point of the inlet raw gas would be lower than the temperature of the pre-dehydrated gas; or (2) The inhibitor used in the coolant in the pre-dehydrator has high foaming tendency so that the temperature of the pre-dehydrated gas has to be controlled below the NGL dew point.

Under either of the above circumstance, no partial NGL condensate would appear in the pre-dehydrator. As a result, the following components should be eliminated in FIG. 6, including: the two-phase separator 7, the condensate outlet pipe 10, the booster pump 11, and the pair of shifting valves 31 and 31*a*. No other modification to FIG. 1 is required.

The rest elements of the flow diagram and all the operation procedures in FIG. 6 are identical to those in FIG. 1. No redundant description is needed.

Figure 7:
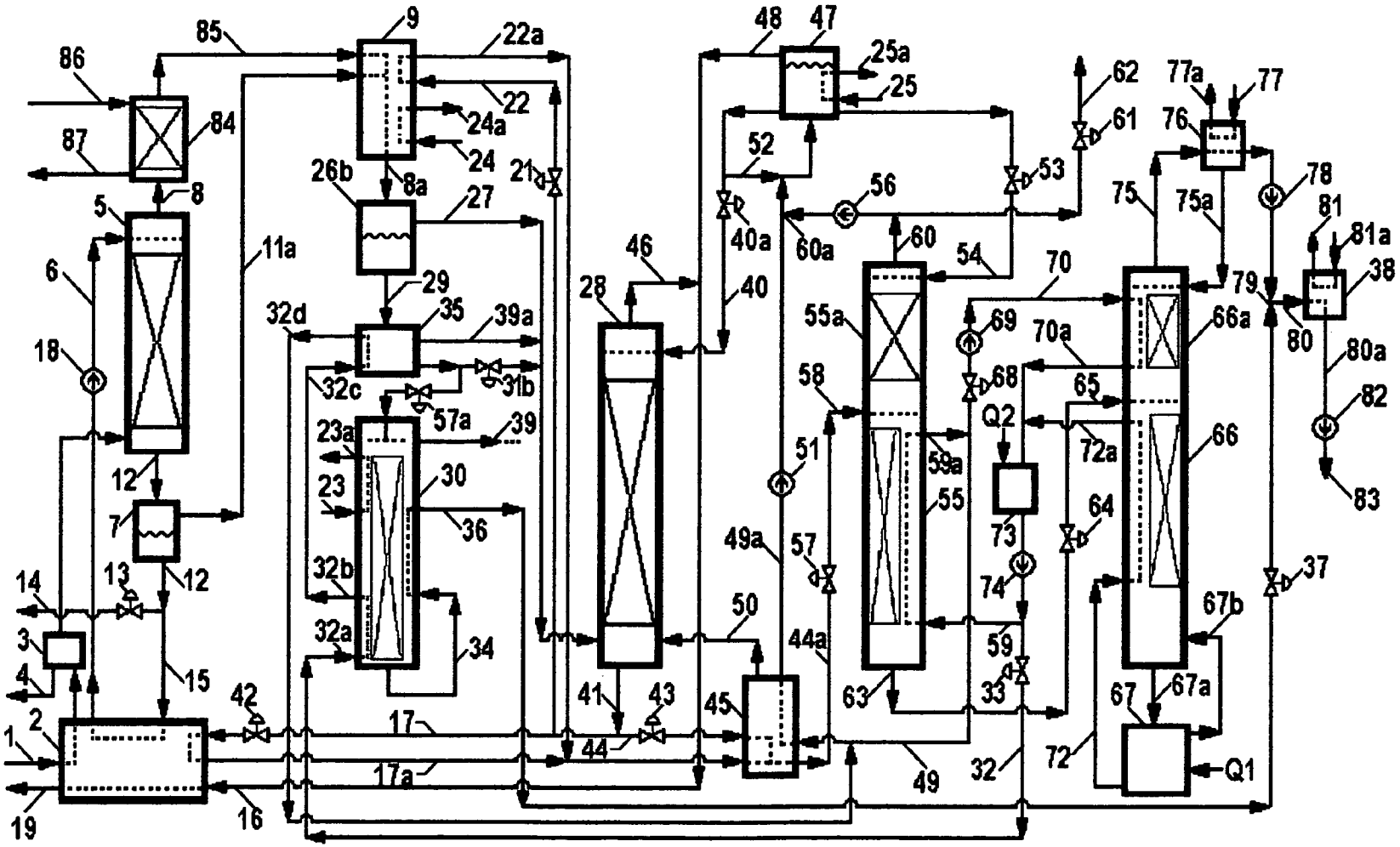
FIG. 7 illustrates still another embodiment of the flexible hydrocarbon gas separation process as illustrated in FIG. 1, wherein a solid adsorbent deep-dehydrator is installed before the pre-dehydrated gas is deep-cooled with a refrigerant.

FIG. 7 illustrates still another embodiment of the flexible hydrocarbon gas separation process as illustrated in FIG. 1, wherein a solid adsorbent deep-dehydrator is installed before the pre-dehydrated gas is deep-cooled with a refrigerant.

As illustrated in FIG. 7, a solid desiccant deep-dehydrator 84 is installed between the original pre-dehydrator 5 and the original deep-dehydrators 9 as illustrated in FIG. 1. Since the moisture of the pre-dehydrated gas is very low, the required capacity of the solid desiccant dehydrator would be rather small. In most circumstance, a once-through cycle operation is preferred. The solid desiccant, loaded into the solid dehydrator via the desiccant inlet pipe 86, is discarded via the desiccant discharge pipe 87 without regeneration.

A special interesting case is the use of the deliquescent solid desiccant such as anhydrous $CaCl_2$. The effluent from the deliquescent solid dehydrator could be used as the make-up inhibitor solution returned to the system via inhibitor make-up pipe 20.

The deep-dehydrated gas, leaving the solid desiccant dehydrator 84 via the solid-dehydrated gas pipeline 85 at the pre-cooling gas temperature, is sent to the deep-cooler 9*a* (replacing prior deep-cooler/dehydrator 9 in FIG. 1). No water vapor would be condensed in the deep-cooler 9*a*; only NGL condensate would appear. The prior three-phase separator 26 in FIG. 1 is replaced with a two-phase gas-liquid separator 26*b*, and the prior recovered inhibitor pipe 27*a* in FIG. 1 is eliminated.

For simplification, in FIG. 7, the partial NGL condensate, if any, is directly sent into the deep-cooler 9*a*. The prior condensate booster pump 11 and the shift valve 31 in FIG. 1 are eliminated.

The rest elements of the flow diagram and all the operation procedures in FIG. 7 are identical to those in FIG. 1. No redundant description is needed.

Figure 8:
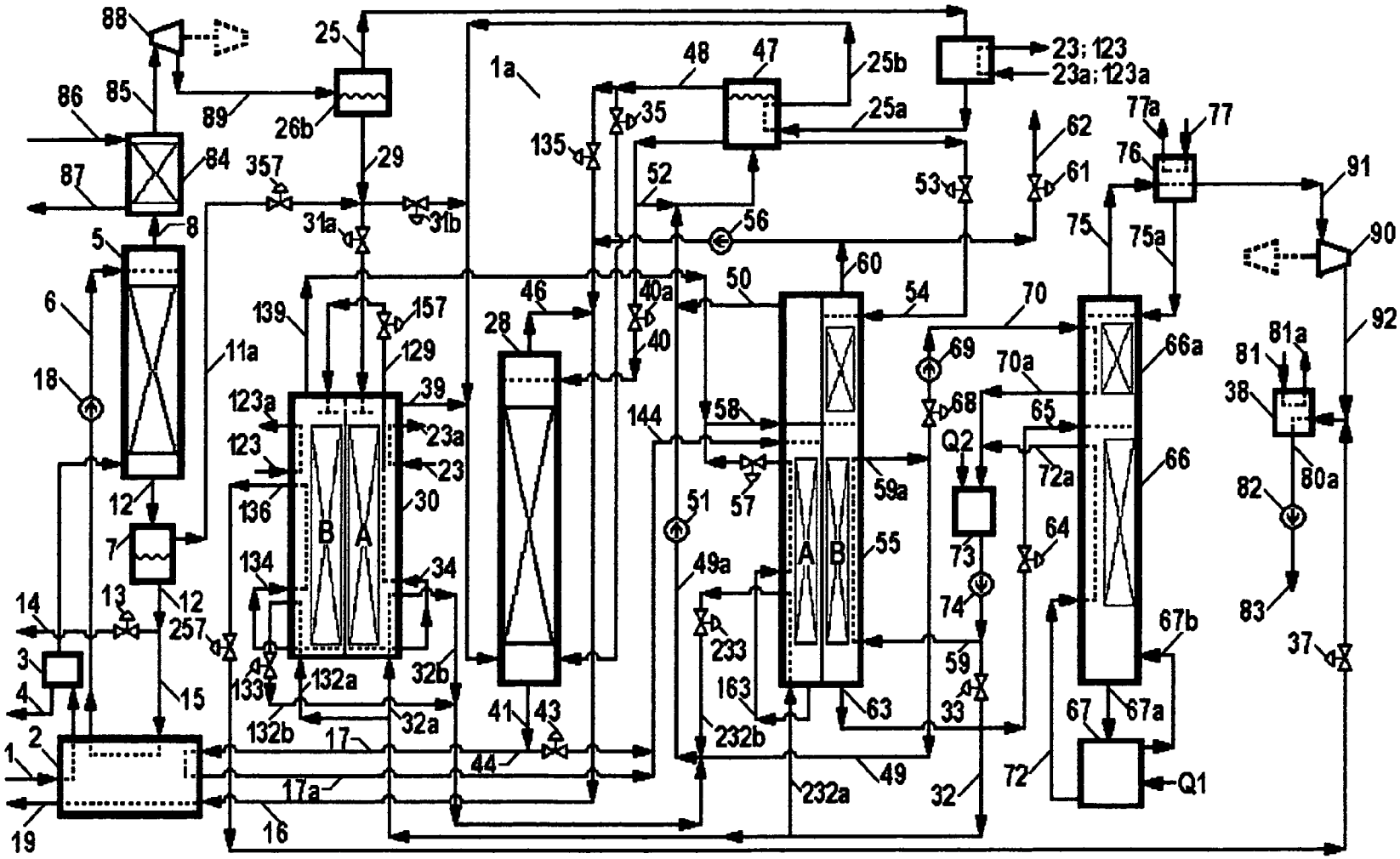
FIG. 8 illustrates an alternative embodiment of the flow diagram of flexible hydrocarbon gas separation process as illustrated in FIG. 7 wherein the raw gas pressure is so high that an internal gas expander could be used to replace the external refrigerator providing the refrigerant for deep-cooling the gas and lean oil.

FIG. 8 illustrates an alternative embodiment of the flow diagram of flexible hydrocarbon gas separation process as illustrated in FIG. 7 wherein the raw gas pressure is so high that an internal gas expander could be used to replace the external refrigerator providing the refrigerant for deep-cooling the gas and lean oil.

As illustrated in FIG. 8, wherein the inlet raw gas pressure is substantially higher than the residue gas transport pipeline, an integrated expander-compressor, 80/90, could be used to provide the refrigeration for the gas and the lean oil in the FIRA process. External refrigerator is no longer required. Significant energy savings are resulted.

The embodiment illustrated in FIG. 8 is based on that in FIG. 7 wherein a solid desiccant deep-dehydrator is used. There are three major differences between FIG. 8 and FIG. 7.

First, in FIG. 8, the expander 88 of an integrated expander-compressor unit (shown partly in solid line and partly in dotted line) is used to expand the deep-dehydrated gas to a sub-low temperature and get the sub-cooled residue gas and the NGL condensate. Both the prior deep-cooler 9 and the prior external refrigerator (not shown in FIG. 7) are eliminated.

The pre-cooled, deep-dehydrated gas leaving the solid desiccant dehydrator 84 enters the expander 88 of the integrated expander-compressor unit, via deep-dehydrated gas inlet pipe 85. The gas temperature after expansion drops substantially lower than the absorber temperature, i.e., <<−40° F. A significant portion of the NGL vapor is condensed. The sub-cooled gas and NGL condensate mixture is separated in the two-phase separator 26*b* into two streams. The sub-cooled gas is sent via sub-low temperature gas inlet pipe 25 into the refrigerant cooler 47*a* and the lean oil pre-saturator 47, cools the refrigerant and lean oil mixture, respectively. The sub-cooled gas temperature, when leaving the pre-saturator 47, should be~−40 F. Then the deep-cooled gas leaves the pre-saturator via the deep-cooled gas inlet pipe 25*a* and enters the flexible absorber 28. The sub-cooled NGL condensate is sent via NGL condensate outlet pipe 29 through the shift valve 31*a* into the first stage of NGL condensate deethanizer 30A. The partial NGL condensate, separated from the two-phase separator 7, if any, is sent via the partial condensate pipe 11*a* through the depressurization valve 357 into the NGL condensate outlet pipe 29.

Secondly, in FIG. 8, the compressor 90 of the integrated expander-compressor unit (shown partly in solid line and partly in dotted line) is used for NGL vapor compression. The prior NGL vapor compressor 79 in FIG. 7 is eliminated.

The pre-cooled NGL vapor enters the compressor 90 via the NGL vapor transfer pipe 91. The NGL vapor is compressed therein, discharged via NGL vapor discharge pipe 92, mixed with the deep-cooled NGL condensate coming through the depressurization valve 37, and then sent into the NGL liquefier 38.

The surplus gas expansion power, if any, could be utilized for other compressor/pumps in the FIRA process. (Not shown in FIG. 8).

Thirdly, in FIG. 8, the integrated cascade flexible deethanizer is used for both NGL condensate and rich oil deethanization. The prior combination of a pre-demethanizer and a flexible deethanizer for both NGL condensate and rich oil in FIG. 7 has been eliminated. The connections of these integrated cascade deethanizers are identical to those in FIG. 5.

The rest elements of the flow diagram and all the operation procedures in FIG. 8 are identical to those in FIG. 7. No redundant description is needed.

In summary, present invention related to a flexible hydrocarbon gas separation process that could dehydrate the water-saturated hydrocarbon gas mixture and recover thereof the required higher hydrocarbons (NGL) therein with a controllable ethane recovery rate (ranging from >95% to <2%) while keeping high recovery rate of all other heavier components. The flexible process comprises the following steps: deep-cooling and dehydrating the raw gas and get the NGL condensate; flowing the deep-dehydrated gas into the flexible absorber to get the rich oil with desirable ethane content; completely demethanizing and partially deethanizing as desired the rich oil and the NGL condensate to get purified rich oil and purified NGL condensate, respectively; separating the NGL vapor from the purified rich oil; cooling and compressing the NGL vapor; mixing the NGL vapor with the purified NGL condensate; and liquefying the mixture to get the final NGL product. The present invention also provides a flexible apparatus with highly efficient components for the flexible process.

Having described the present invention and preferable embodiments thereof, it will be recognized that numerous variations, substitutions and additions may be made to the present invention by those ordinary skills without departing from the spirit and scope of the appended claims.

What is claimed is:

1. A flexible hydrocarbon gas separation process that could dehydrate a water-saturated hydrocarbon gas ("raw gas" hereafter) and recover thereof the higher hydrocarbon liquid ("NGL" hereafter) with controllable ethane recovery rate ranging from >95% to <2% while keeping high recovery rate of all other heavier hydrocarbon components comprises the following steps:

(a) Pre-cooling and pre-dehydrating the raw gas by directly contacting a counter-flowing liquid coolant comprising an aqueous solution of a gas hydrate inhibitor to get a pre-cooled pre-dehydrated gas and a partial NGL condensate;

(b) Deep-cooling and deep-dehydrating the pre-cooled pre-dehydrated gas with a refrigerant from an external refrigerator to get a deep-cooled deep-dehydrated gas and a deep-cooled NGL condensate;

(c) Flowing the NGL condensate into a condensate pre-demethanizer and a flexible condensate deethanizer in tandem to remove all the methane content therein and simultaneously reduce the ethane content therein to any desirable level to get a deep-cooled purified NGL condensate;

(d) Flowing the deep-cooled deep-dehydrated gas into a flexible absorber and contacting the gas with a counter-flowing liquid absorbent ("lean oil" hereafter) to get a cold residue gas and a cold rich absorbent ("rich oil" hereafter) with a desirable level of ethane content;

(e) Flowing the cold rich oil into a rich oil pre-demethanizer and a flexible rich oil deethanizer in tandem to remove all the methane content therein and simultaneously reduce the ethane content therein to any desirable level to get a purified rich oil;

(f) Depressurizing the purified rich oil and distilling the purified rich oil in a rich oil fractionator to get an NGL vapor and a regenerated lean oil;

(g) Cooling the NGL vapor with a heat transport medium to transport the heat energy from the NGL vapor to the deep-cooled rich oil in the flexible rich oil deethanizer;

(h) Compressing the NGL vapor and mixing the compressed NGL vapor with the deep-cooled purified NGL condensate to get a low-temperature NGL vapor-liquid mixture; and (i) Liquefying the low-temperature NGL vapor-liquid mixture to get a final NGL product.

2. The flexible hydrocarbon gas separation process of claim 1 wherein in step (a) the liquid coolant comprising an aqueous solution of a gas hydrate inhibitor is pre-cooled with the cold residue gas and the cold rich oil before being used as the coolant in step (a).

3. The flexible hydrocarbon gas separation process of claim 1 wherein in step (b) the pre-cooled pre-dehydrated gas is mixed with the partial NGL condensate before being deep-cooled with a refrigerant to get the deep-cooled deep-dehydrated gas and the NGL condensate.

4. The flexible hydrocarbon gas separation process of claim 1 wherein in step (b) the pre-cooled pre-dehydrated gas is mixed with a spray of concentrated gas hydrate inhibitor solution before being deep-cooled with a refrigerant to get the deep-cooled deep-dehydrated gas and the NGL condensate.

5. The flexible hydrocarbon gas separation process of claim 1 wherein in step (b) the pre-cooled pre-dehydrated gas is further deep-dehydrated with a solid desiccant to get the deep-dehydrated gas before further deep-cooled with a refrigerant.

6. The flexible hydrocarbon gas separation process of claim 5 wherein the solid desiccant is calcium chloride or other deliquesce solid desiccants that would be liquefied when absorbing sufficient water, and the deliquescent liquid is then used as the concentrated hydrate inhibitor solution.

7. The flexible hydrocarbon gas separation process of claim 1 wherein in step (c) and (e) the working pressure and bottom temperature of the deethanizer is controlled to precisely reduce the ethane content of the purified condensate to desirable level.

8. The flexible hydrocarbon gas separation process of claim 1 wherein in step (c) and (e) the tandem process with the pre-demethanizer and the deethanizer is replaced with the integrated process of a integrated cascade flexible deethanizer.

9. The flexible hydrocarbon gas separation process of claim 1 wherein in step (d) the absorbent used in the absorber could be either heavy oils (i.e., hydrocarbon mixture with molecular weight higher than 100) or other organic compounds with hydrocarbon gas solubility higher than 20 scf/gal.

10. The flexible hydrocarbon gas separation process of claim 1 wherein in step (d) the ethane recovery rate in the flexible absorber is precisely controlled by changing the lean oil flow rate.

11. The flexible hydrocarbon gas separation process of claim 1 wherein in step (f) the regenerated lean oil is recycled as a heating medium.

12. The flexible hydrocarbon gas separation process of claim 1 wherein in step (g) the heat transport medium is a cooled recycling lean oil.

13. A flexible hydrocarbon gas separation process that could dehydrate a water-saturated raw hydrocarbon gas under high pressure and recover thereof the NGL with controllable ethane recovery rate ranging from >95% to <2% while keeping high recovery rate (over 90%) of all other heavier hydrocarbon components comprises the following steps:

(a) Pre-cooling and pre-dehydrating the raw gas by directly contacting a counter-flowing liquid coolant comprising an aqueous solution of a gas hydrate inhibitor to get a pre-cooled pre-dehydrated gas and a partial NGL condensate;

(b) Deep-dehydrating the pre-cooled pre-dehydrated gas with a solid desiccant to get a pre-cooled deep-dehydrated gas;

(c) Expanding the pre-cooled deep-dehydrated gas to a lower pressure and temperature to get a deep-cooled deep-dehydrated gas and an NGL condensate;

(d) Flowing the NGL condensate and the partial NGL condensate into a condensate pre-demethanizer and a flexible condensate deethanizer in tandem to remove all the methane content therein and simultaneously reduce the ethane content therein to any desirable level to get a deep-cooled purified NGL condensate;

(e) Flowing the deep-cooled deep-dehydrated gas into a flexible absorber and contacting the gas with a counter-flowing liquid absorbent ("lean oil" hereafter) to get a cold residue gas and a cold rich oil with a desirable level of ethane content;

(f) Flowing the cold rich oil into a rich oil pre-demethanizer and a flexible rich oil deethanizer in tandem to remove all the methane content therein and simultaneously reduce the ethane content therein to any desirable level to get a purified rich oil;

(g) Depressurizing the purified rich oil and distilling the purified rich oil in a rich oil fractionator to get an NGL vapor and a regenerated lean oil;

(h) Cooling the NGL vapor with a heat transport medium to transport the heat energy from the NGL vapor to the deep-cooled rich oil in the flexible rich oil deethanizer;

(i) Compressing the NGL vapor and mixing the compressed NGL vapor with the deep-cooled purified NGL condensate to get a low-temperature NGL vapor-liquid mixture; and (j) Liquefying the low-temperature NGL vapor-liquid mixture to get a final NGL product.

* * * * *